US011982511B2

(12) United States Patent
Melville

(10) Patent No.: US 11,982,511 B2
(45) Date of Patent: May 14, 2024

(54) QUICK DETACH MOUNTING SYSTEM

(71) Applicant: Toby Melville, Lakehills, TX (US)

(72) Inventor: Toby Melville, Lakehills, TX (US)

( * ) Notice: Subject to any disclaimer, the term of this patent is extended or adjusted under 35 U.S.C. 154(b) by 0 days.

(21) Appl. No.: 18/095,714

(22) Filed: Jan. 11, 2023

(65) Prior Publication Data

US 2023/0221097 A1 Jul. 13, 2023

Related U.S. Application Data

(60) Provisional application No. 63/299,225, filed on Jan. 13, 2022.

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 11/001; F41G 1/38; F41G 1/387; F41G 1/393; F41G 1/40; F41G 1/41; F16M 11/00; F16M 11/041; F16M 11/04
USPC ..... 42/90
See application file for complete search history.

(56) References Cited

U.S. PATENT DOCUMENTS 6,371,424 B1 * 4/2002 Shaw ..... F41G 1/54 248/222.12
8,393,105 B1 * 3/2013 Thummel ..... F41G 11/003 42/127
8,468,735 B1 * 6/2013 Keng ..... F41G 1/08 42/148
9,677,854 B1 * 6/2017 Tran ..... F41G 11/003
10,222,172 B2 3/2019 Melville
2009/0013580 A1 * 1/2009 Houde-Walter ..... F41G 1/35 42/114
2011/0030263 A1 * 2/2011 Larsson ..... F41C 27/00 42/90
2011/0076095 A1 * 3/2011 Storch ..... F41G 11/003 403/322.4
2013/0000176 A1 * 1/2013 Goertzen ..... F41G 11/003 42/90
2014/0093314 A1 * 4/2014 Kessler ..... F16M 11/041 403/361
2014/0109345 A1 * 4/2014 Melville ..... F41C 33/006 24/3.1
2014/0196348 A1 * 7/2014 Samson ..... F41C 27/00 42/90
2014/0252187 A1 * 9/2014 Petrovic ..... F16B 2/185 248/229.16
2015/0068094 A1 * 3/2015 Seuk ..... F41G 11/003 42/90
2015/0135573 A1 * 5/2015 DiChario ..... F41A 3/66 42/75.02

(Continued)

*Primary Examiner* — Joshua E Freeman
(74) *Attorney, Agent, or Firm* — Christopher L. Makay

(57) ABSTRACT

A quick detach mounting system includes a base, an adapter, and a lock. The base includes a frame, a guide atop the frame, and a clamp configured to secure the base with a rail. The adapter includes a central beam, a platform atop the central beam configured to provide a securing point for accessories with the adapter, and an interface extending below the central beam engageable with the guide in order to couple the adapter with the base. The lock integrates with the base and is moveable between a lock position that secures the adapter with the base and an unlock position that releases the adapter from the base.

3 Claims, 29 Drawing Sheets

(56) References Cited

U.S. PATENT DOCUMENTS

| | | | | |
|---|---|---|---|---|
| 2015/0159977 | A1* | 6/2015 | Tseng | F41C 23/12<br>42/75.03 |
| 2017/0045334 | A1* | 2/2017 | Yim | F41G 11/003 |
| 2018/0202770 | A1* | 7/2018 | Pniel | F41G 1/16 |
| 2019/0078853 | A1* | 3/2019 | Johnson, Sr. | F41A 23/14 |
| 2019/0277604 | A1* | 9/2019 | Ball | F41G 1/387 |
| 2022/0140629 | A1* | 5/2022 | Yang | F41G 11/003<br>42/131 |
| 2023/0112612 | A1* | 4/2023 | Lee | F41G 11/001<br>42/125 |
| 2023/0213316 | A1* | 7/2023 | Chester | F41G 11/003<br>42/136 |

* cited by examiner

QUICK DETACH MOUNTING SYSTEM

BACKGROUND OF THE INVENTION

1. Field of the Invention

The present invention relates generally to mounting systems and, more particularly, but not way of limitation, to a quick detach mounting system that releasably attaches accessories such as, for example, optics, sights, laser pointers, flashlights, and the like, to equipment, such as, for example, rifles, pistols, shotguns, submachine guns, and the like.

2. Description of the Related Art

Tactical operators, soldiers, law enforcement personnel, and civilians require mounting systems for attaching accessories such as optics, sights, laser pointers, and flashlights to their equipment including weapons such as rifles, pistols and shotguns. For a sighting accessory such as an optic, a red dot sight, and a laser pointer, a mounting system must securely hold the sighting accessory while firmly attaching the sighting accessory to a weapon in order for the sighting accessory to maintain its "zero" with respect to the weapon. Traditional mounting systems are semi-permanent in that attaching and removing such a mounting system requires a time-consuming use of tools. However, with the increase in availability of different sighting accessories, such as, for example, day and night optics, a need has arisen for mounting systems that do not require tools when used to switch between sighting accessories employed with the same weapon. In accordance therewith, releasable mounting systems that separate from a weapon without tools have been developed. Nevertheless, while releasable mounting systems operate without tools, these releasable mounting systems are still relatively time-consuming to use due to their release mechanisms in combination with the time and the attention required to locate the releasable mounting system on a weapon in the exact position necessary for the sighting device to maintain its "zero" with respect to the weapon.

Accordingly, a quick detach mounting system configured for fast deployment that also, when used to attach a sighting device to a weapon, ensures the sighting device maintains its "zero" relative to the weapon will improve over current releasable mounting systems.

SUMMARY OF THE INVENTION

In accordance with the present invention, a quick detach mounting system includes a base comprised of a frame, a guide atop the frame, and a clamp configured to secure the base with a rail. The frame includes a rear end, a front end, and a lock slot adjacent the rear end. The guide tapers from the rear end to the front end to define a socket. The guide further includes a first guide rail defining a first guide groove and a second guide rail defining a second guide groove.

The quick detach mounting system includes a lock configured to integrate with the base such that a bolt of the lock resides above the lock slot. The lock is moveable along the lock slot of the base between a lock position and an unlock position.

The quick detach mounting system includes an adapter comprised of a central beam, a platform atop the central beam configured to provide a securing point for accessories with the adapter, and an interface extending below the central beam. The interface tapers from a rear end to a front end. The interface at a first side includes a first tongue whereby the first tongue and the first guide groove are complementary. The interface at a second side includes a second tongue whereby the second tongue and the second guide groove are complementary. The interface defines a lock channel beginning with an opening at the front end and terminating adjacent the rear end. The lock channel is configured to receive the bolt of the lock therein. The interface defines a lock pocket operatively linked with the lock channel. The lock pocket is configured to receive the bolt therein as the bolt exits the lock channel and enters the lock pocket when the lock moves from the unlock position to the lock position.

The adapter is configured for integration with the base whereby the interface inserts into the pocket of the guide until the first tongue of the interface integrates with the first guide groove of the first guide rail and the second tongue of the interface integrates with the second guide groove of the second guide rail. In addition, the bolt of the lock enters the lock channel at the opening of the interface. The bolt, as the interface inserts into the pocket of the guide, traverses the lock channel whereby the lock resides in the unlock position. The bolt, upon insertion of the interface into the pocket of the guide, enters the lock pocket from the lock channel as the lock moves from the unlock position to the lock position, thereby locking the interface within the guide such that the adapter integrates with the base.

The adapter is configured for removal from the base whereby the bolt, upon movement of the lock from the lock position to the unlock position, enters the lock channel from the lock pocket, thereby unlocking the adapter from the base. After unlocking the adapter from the base, the interface withdraws from the pocket of the guide until the first tongue of the interface exits the first guide groove of the first guide rail and the second tongue of the interface exits the second guide groove of the second guide rail. The bolt, as the interface withdraws from the pocket of the guide, traverses the lock channel and exits the lock channel at the opening of the interface such that the lock moves from the unlock position to the lock position. The interface exits the pocket of the guide and the lock, thereby releasing the interface from within the guide in order to remove the adapter from the base.

It is therefore an object of the present invention to provide a quick detach mounting system configured for fast deployment.

It is another object of the present invention to provide a quick detach mounting system that, when used to attach a sighting device to a weapon, ensures the sighting device maintains its "zero" relative to the weapon.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

Figure 1A:
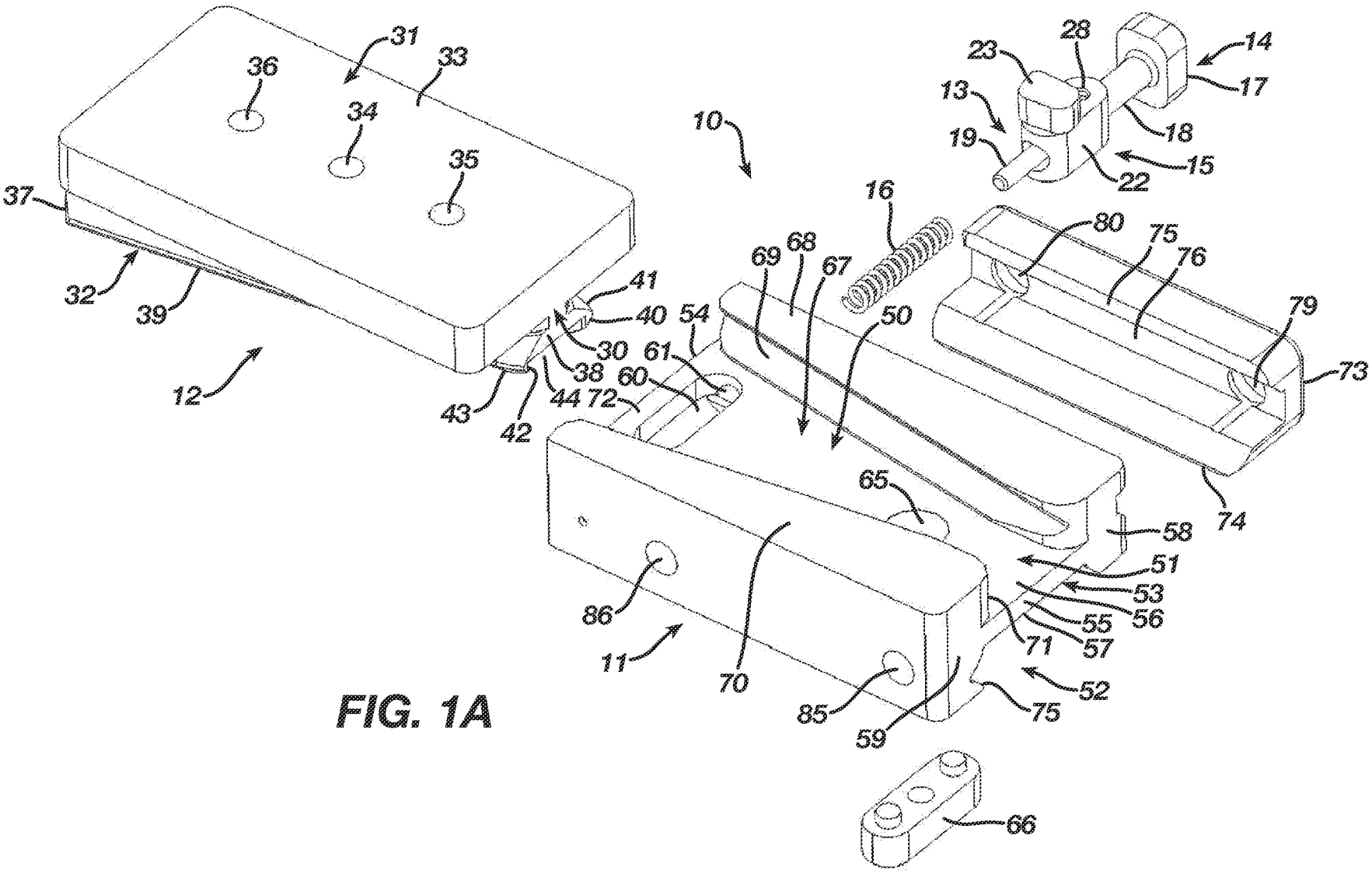
FIG. 1A is an exploded top isometric view illustrating a quick detach mounting system according to a preferred embodiment.
Figure 1B:
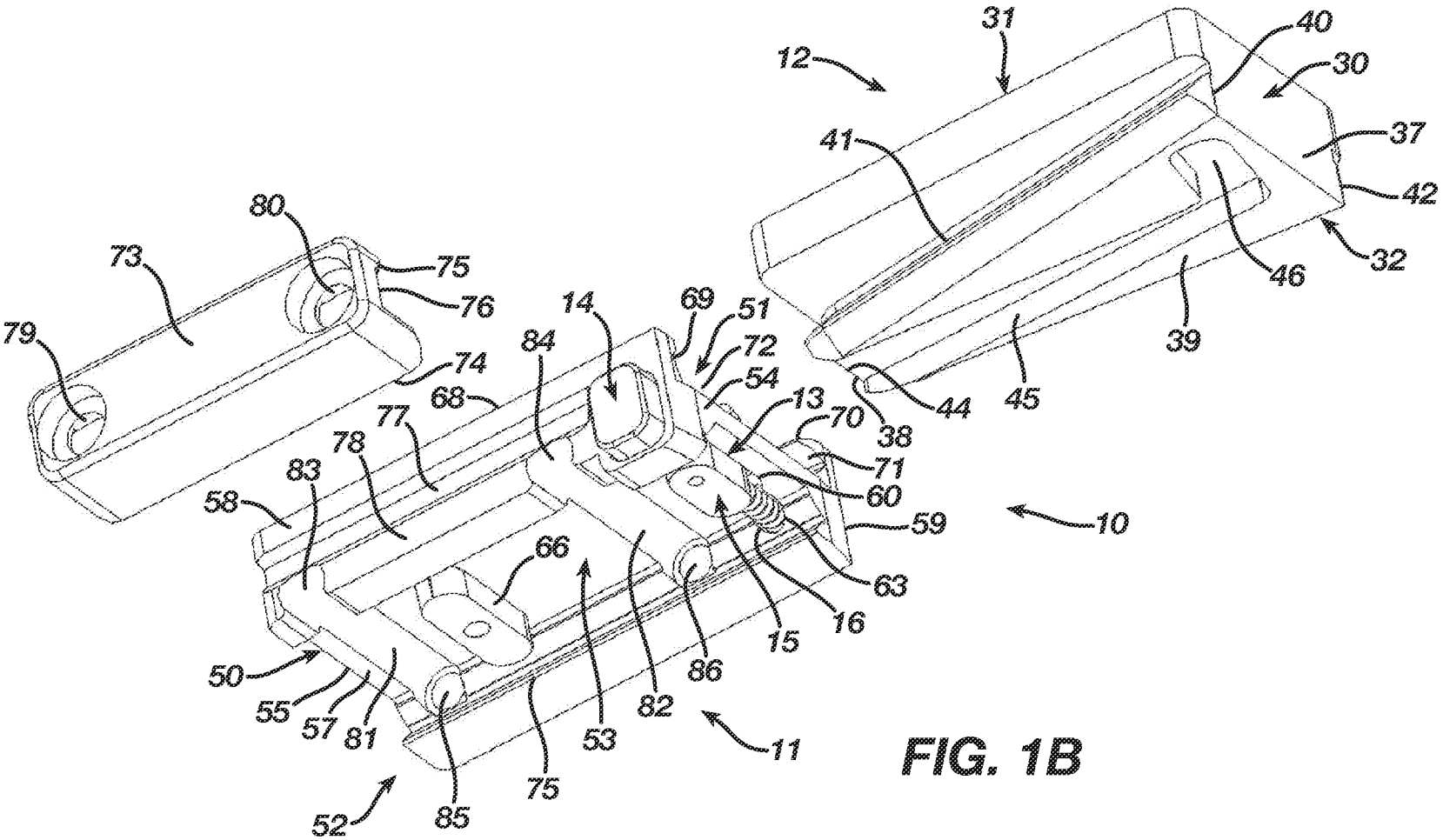
FIG. 1B is an exploded bottom isometric view illustrating the quick detach mounting system.
Figure 2A:
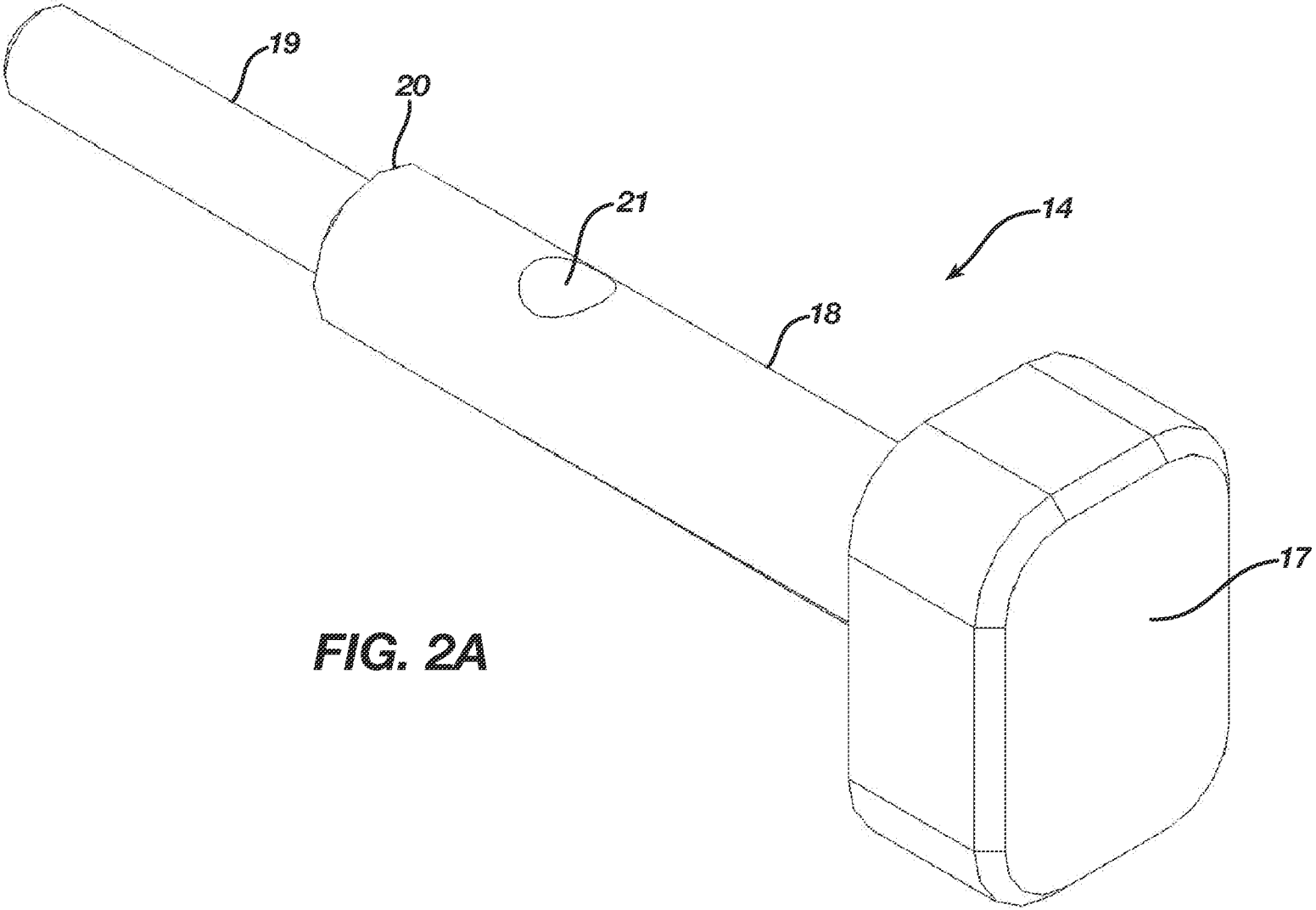
FIG. 2A is a top isometric view illustrating a plunger for a lock of the quick detach mounting system according to the preferred embodiment.
Figure 2B:
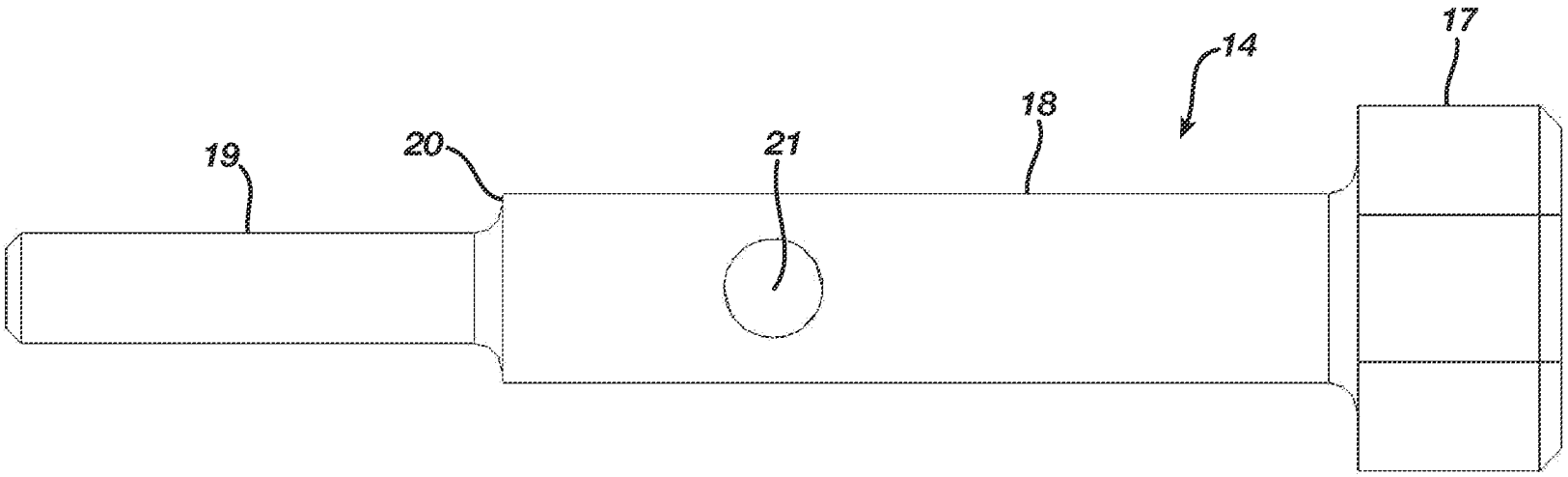
FIG. 2B is a top view illustrating the plunger.
Figure 3A:
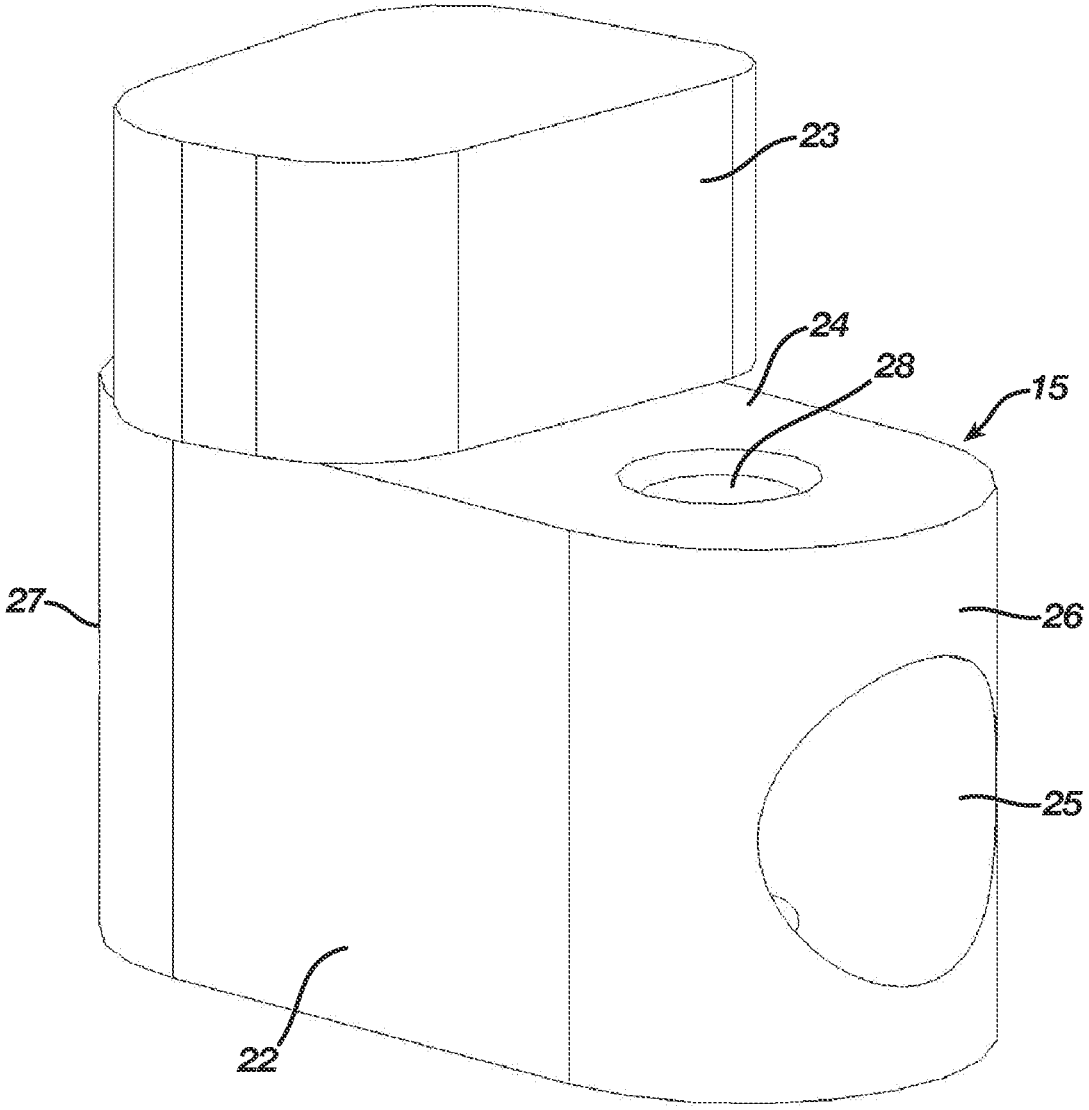
FIG. 3A is a top isometric view illustrating a latch for the lock of the quick detach mounting system according to the preferred embodiment.
Figure 3B:
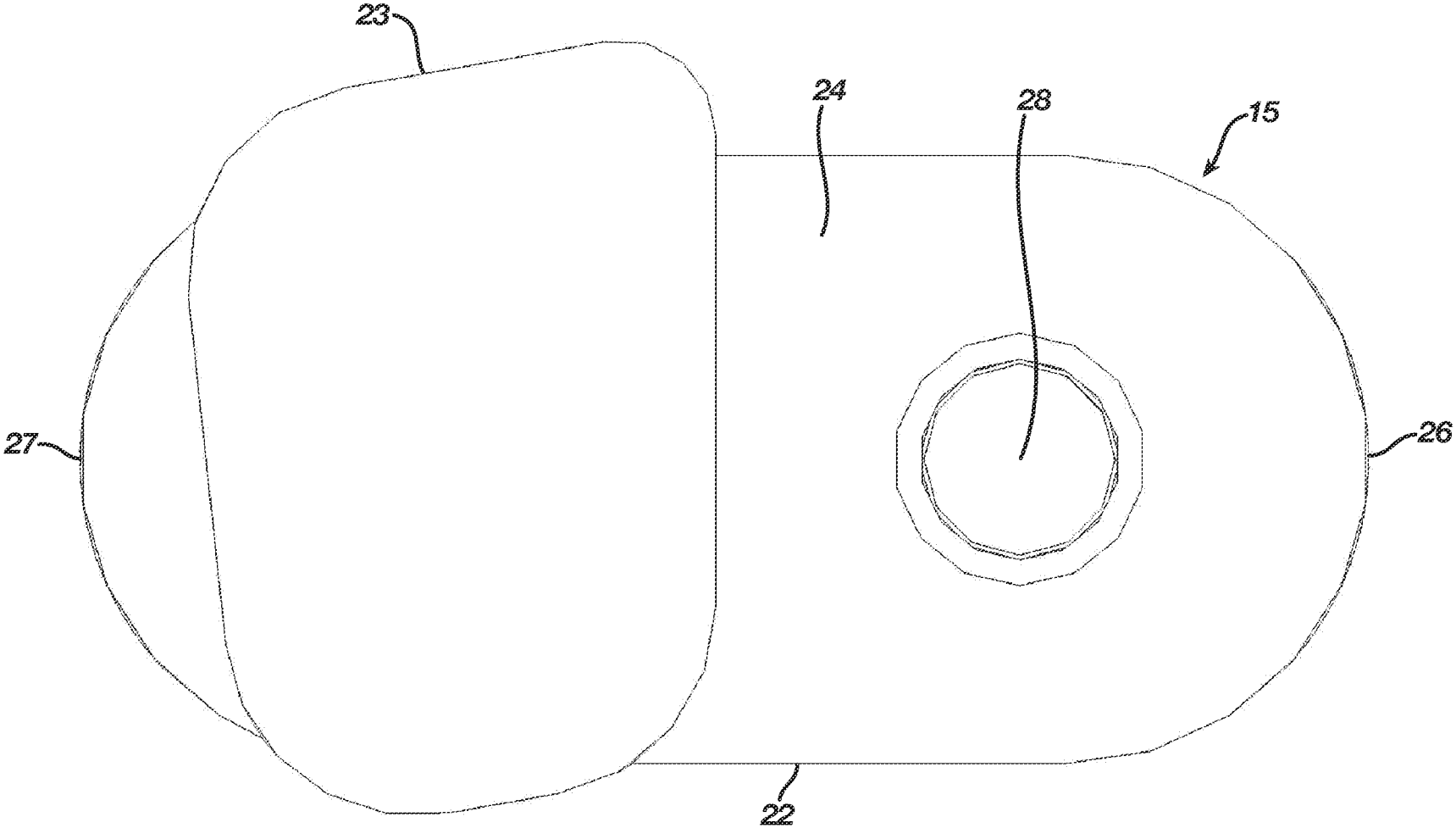
FIG. 3B is a top view illustrating the latch.
Figure 3C:
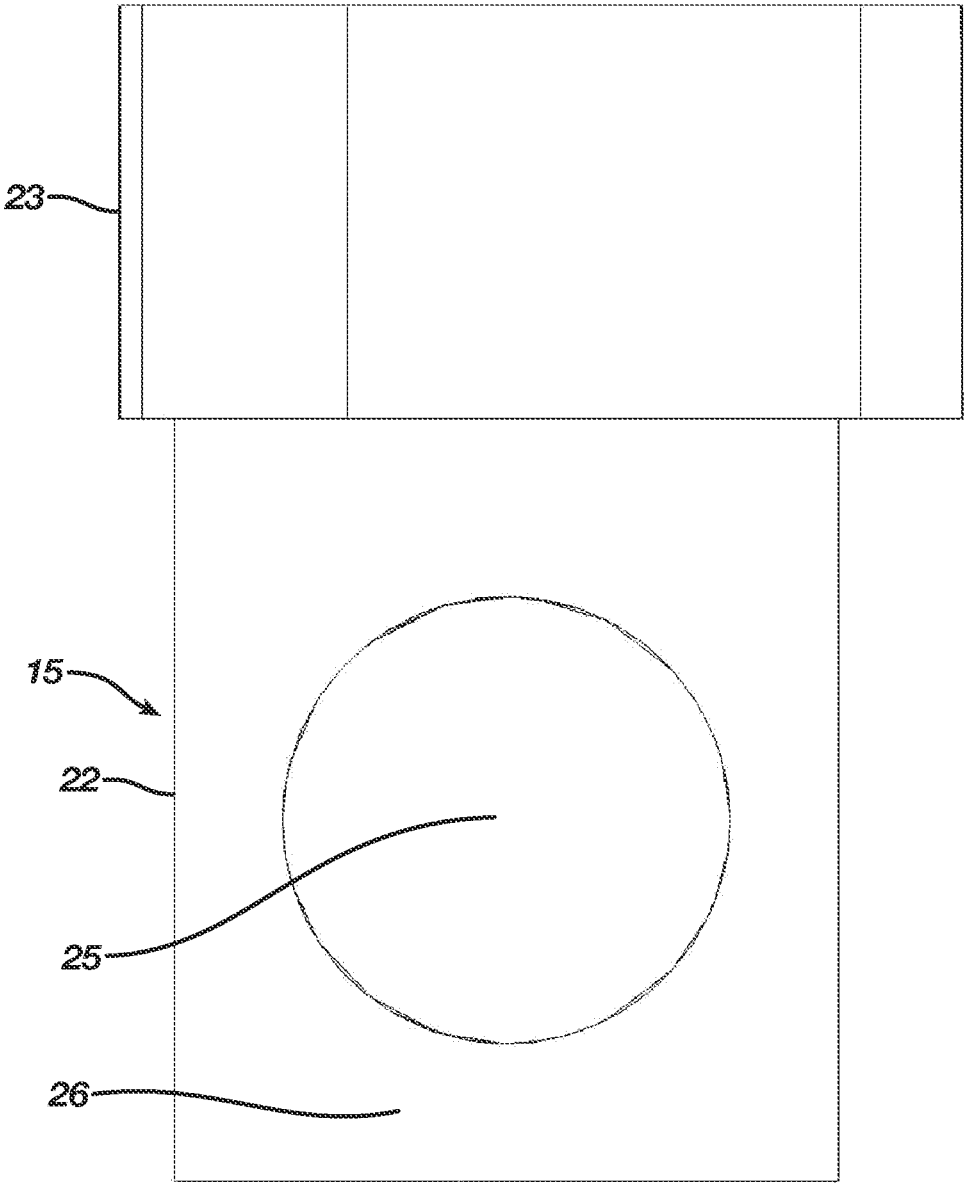
FIG. 3C is an end view illustrating the latch.
Figure 4A:
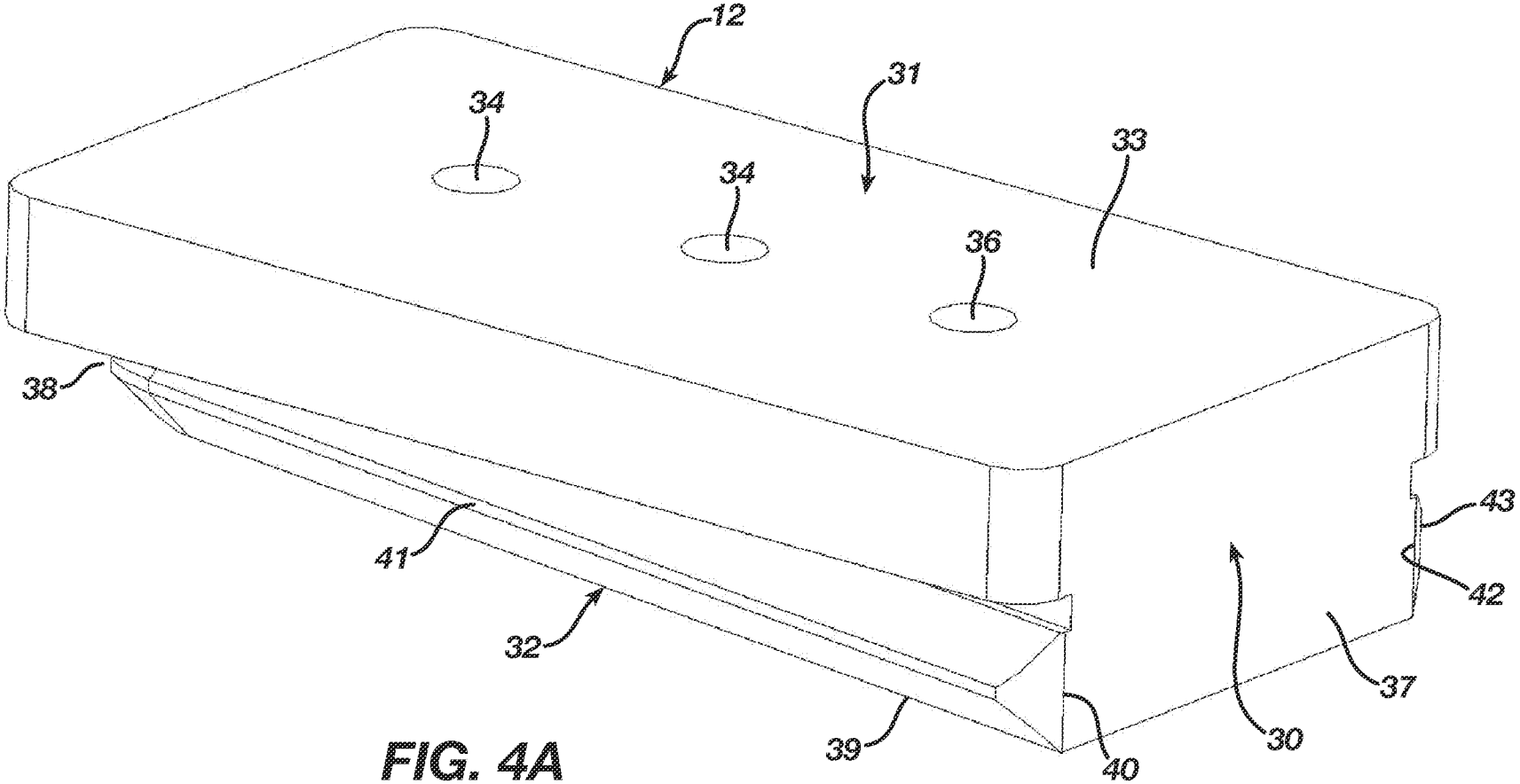
FIG. 4A is a top isometric view illustrating an adapter of the quick detach mounting system according to the preferred embodiment.
Figure 4B:
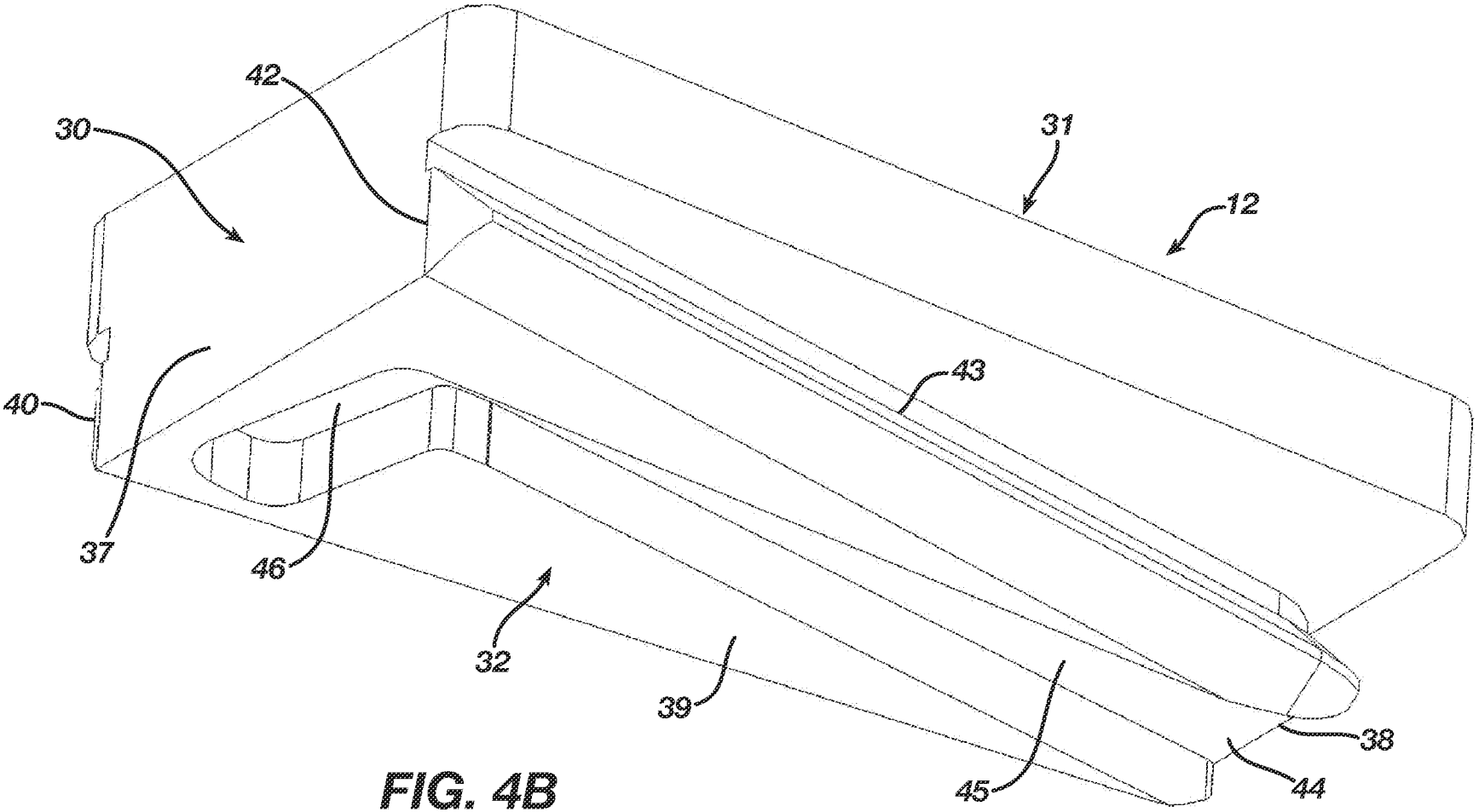
FIG. 4B is a bottom isometric view illustrating the adapter.
Figure 4C:
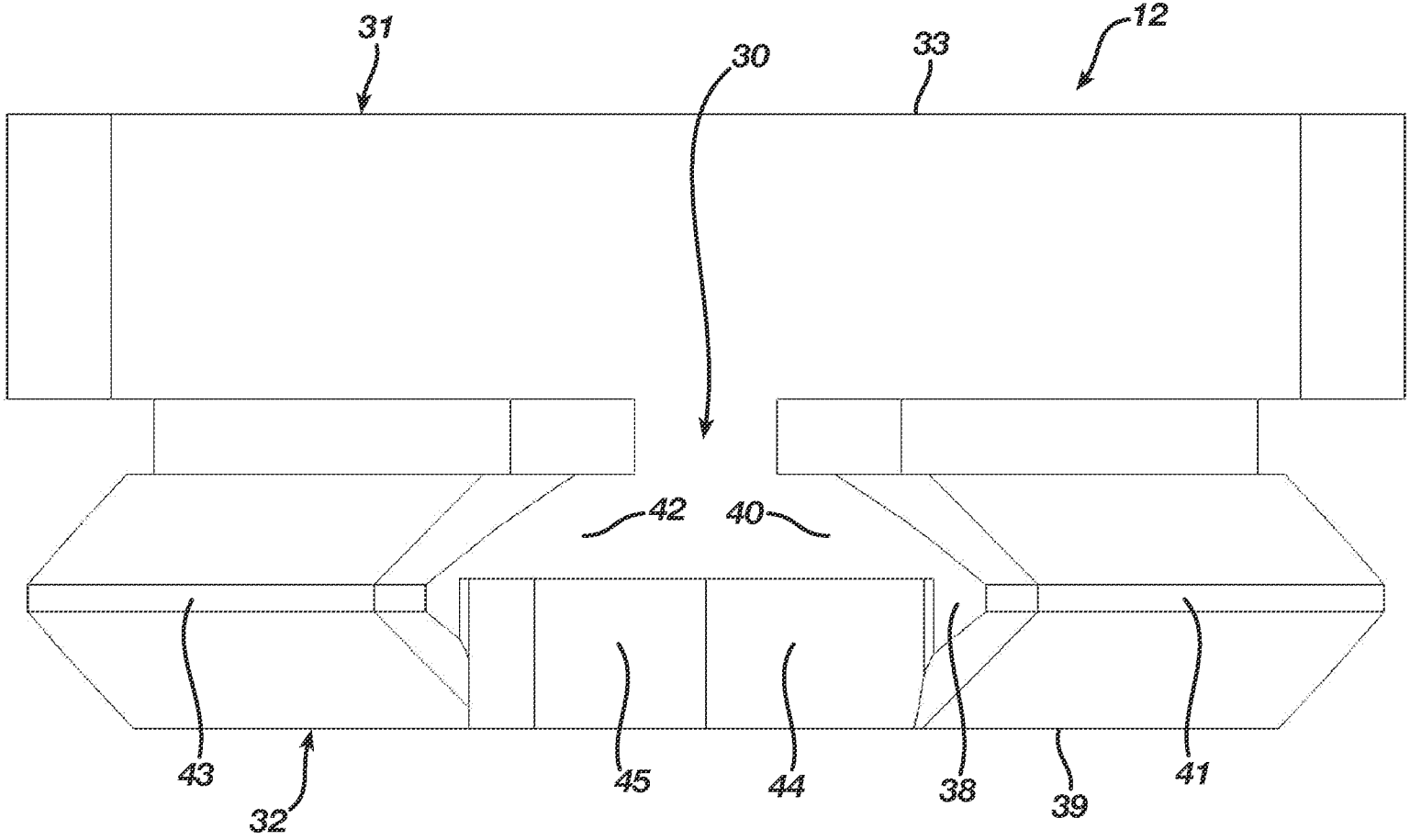
FIG. 4C is an end view illustrating the adapter.
Figure 4D:
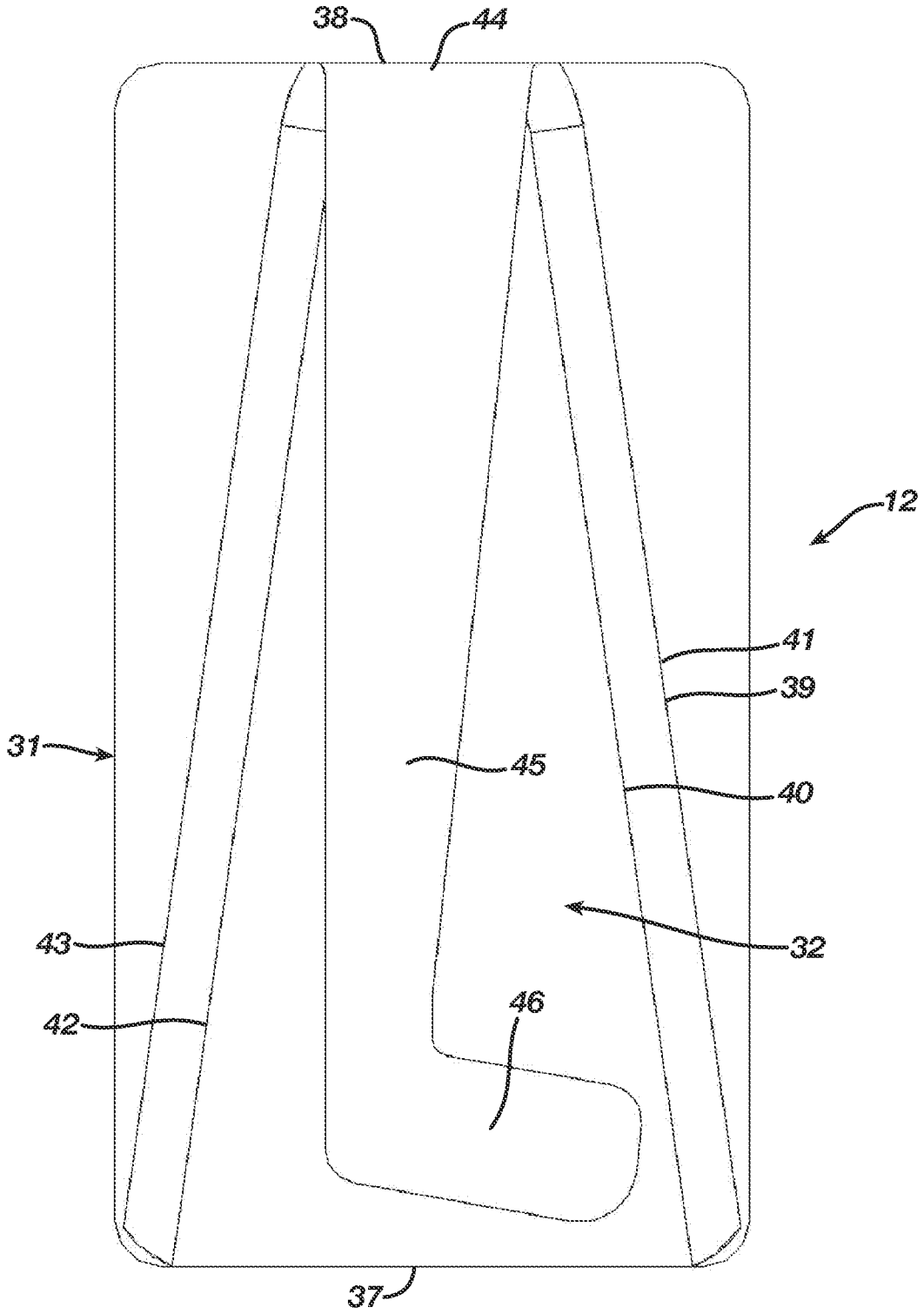
FIG. 4D is a bottom view illustrating the adapter.
Figure 5A:
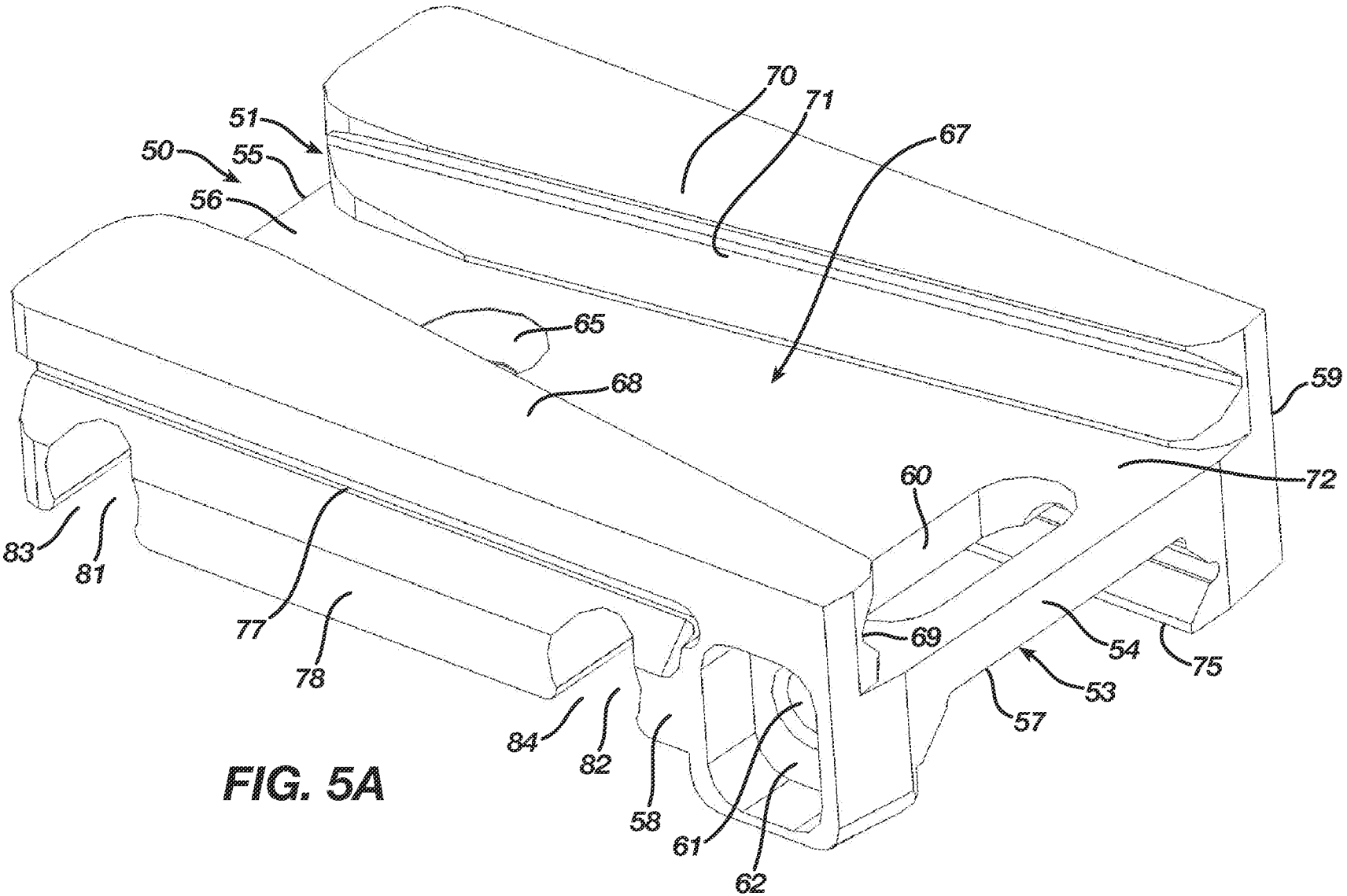
FIGS. 5A-5B are top isometric views illustrating a frame, a guide, and a first jaw of a base for the quick detach mounting system according to the preferred embodiment.
Figure 5B:
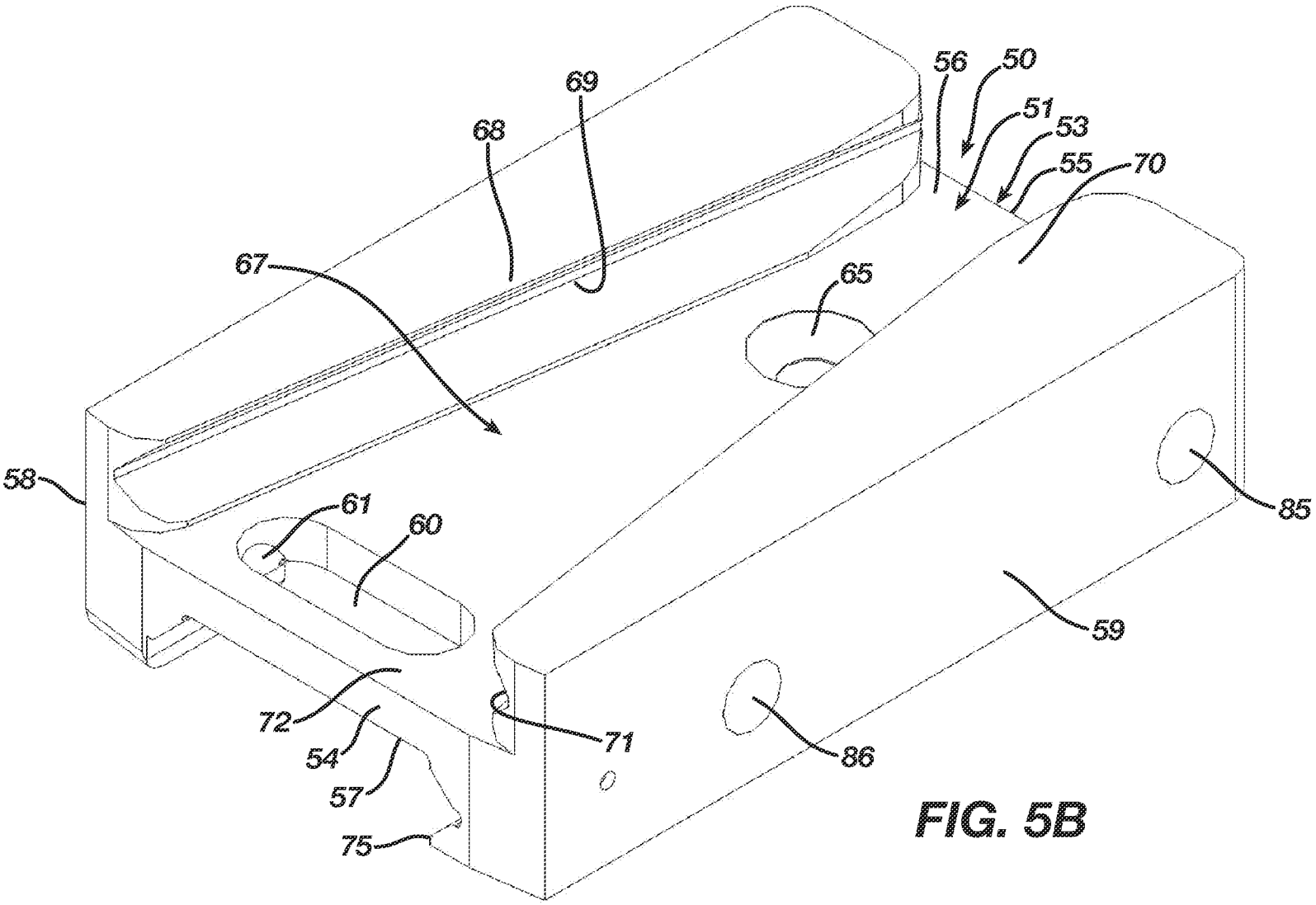
Figure 5C:
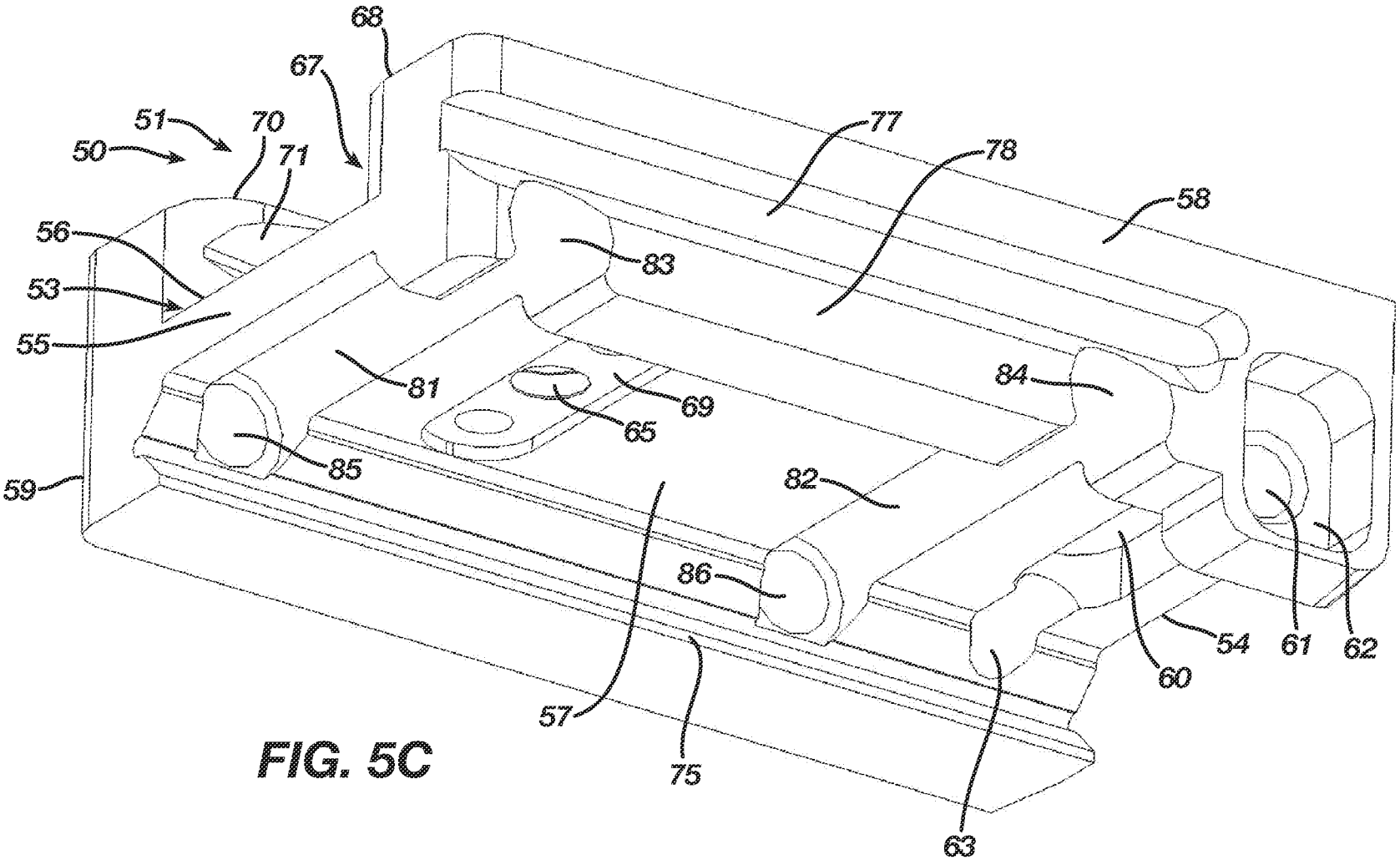
FIGS. 5C-5D are bottom isometric views illustrating the frame, the guide, and the first jaw of the base.
Figure 5D:
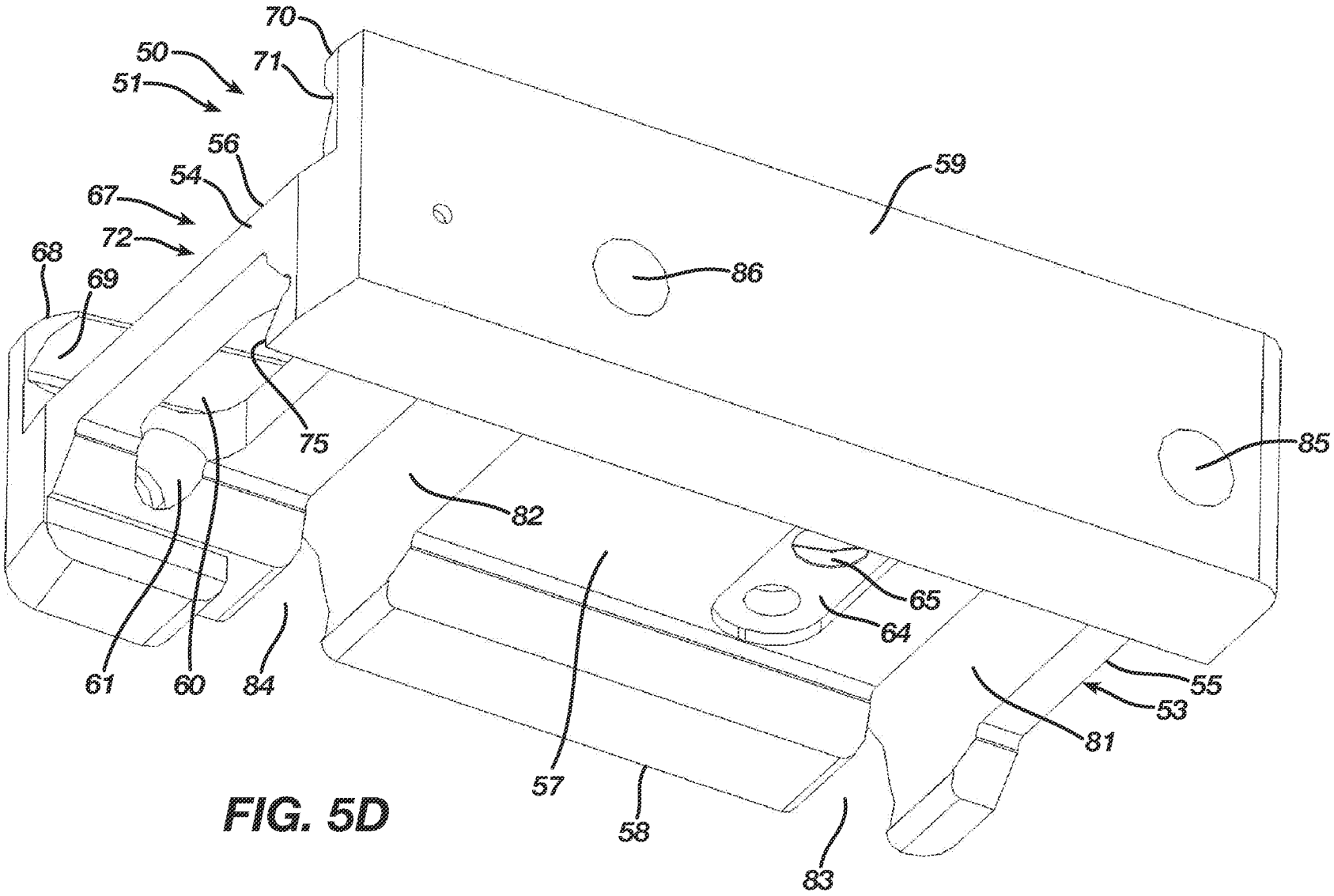
Figure 5E:
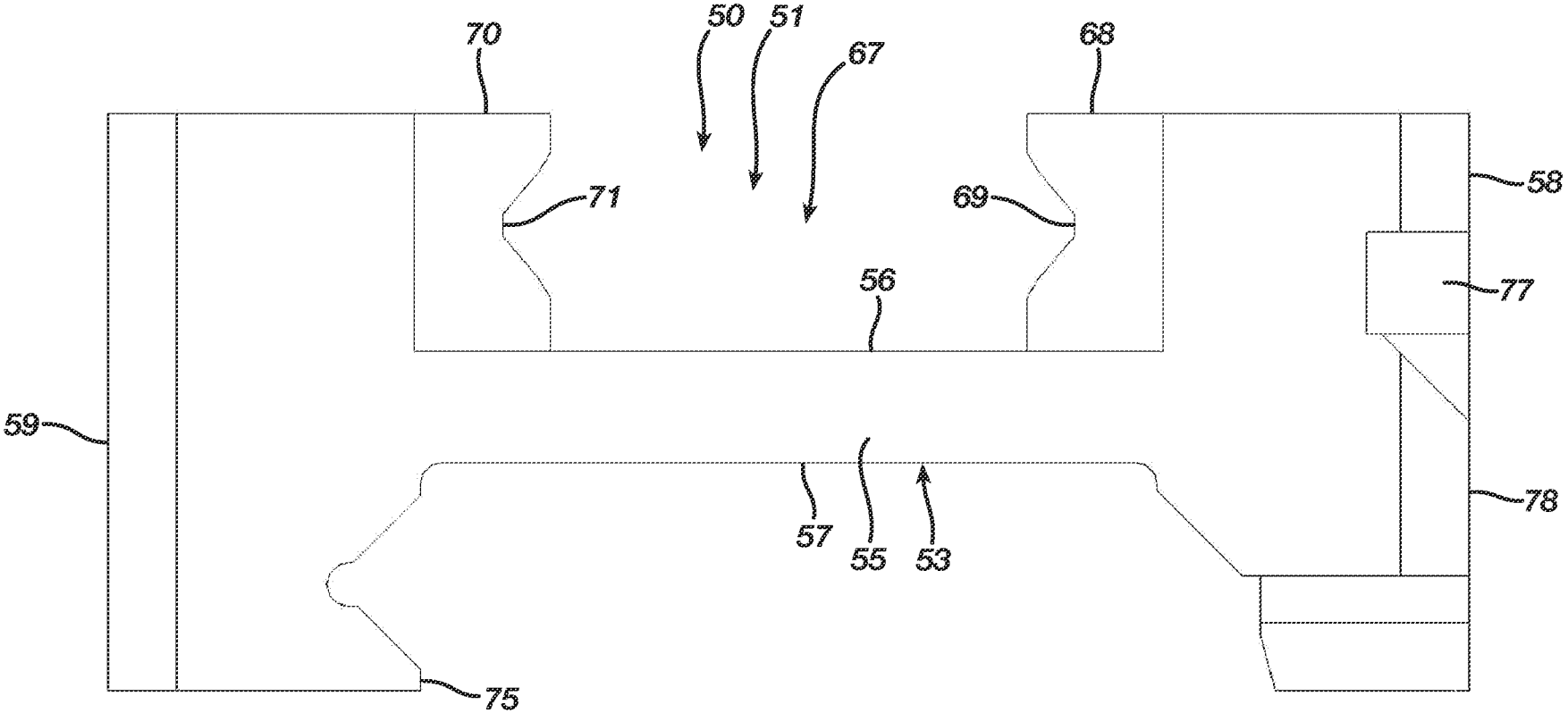
FIG. 5E is an end view illustrating the frame, the guide, and the first jaw of the base.
Figure 5F:
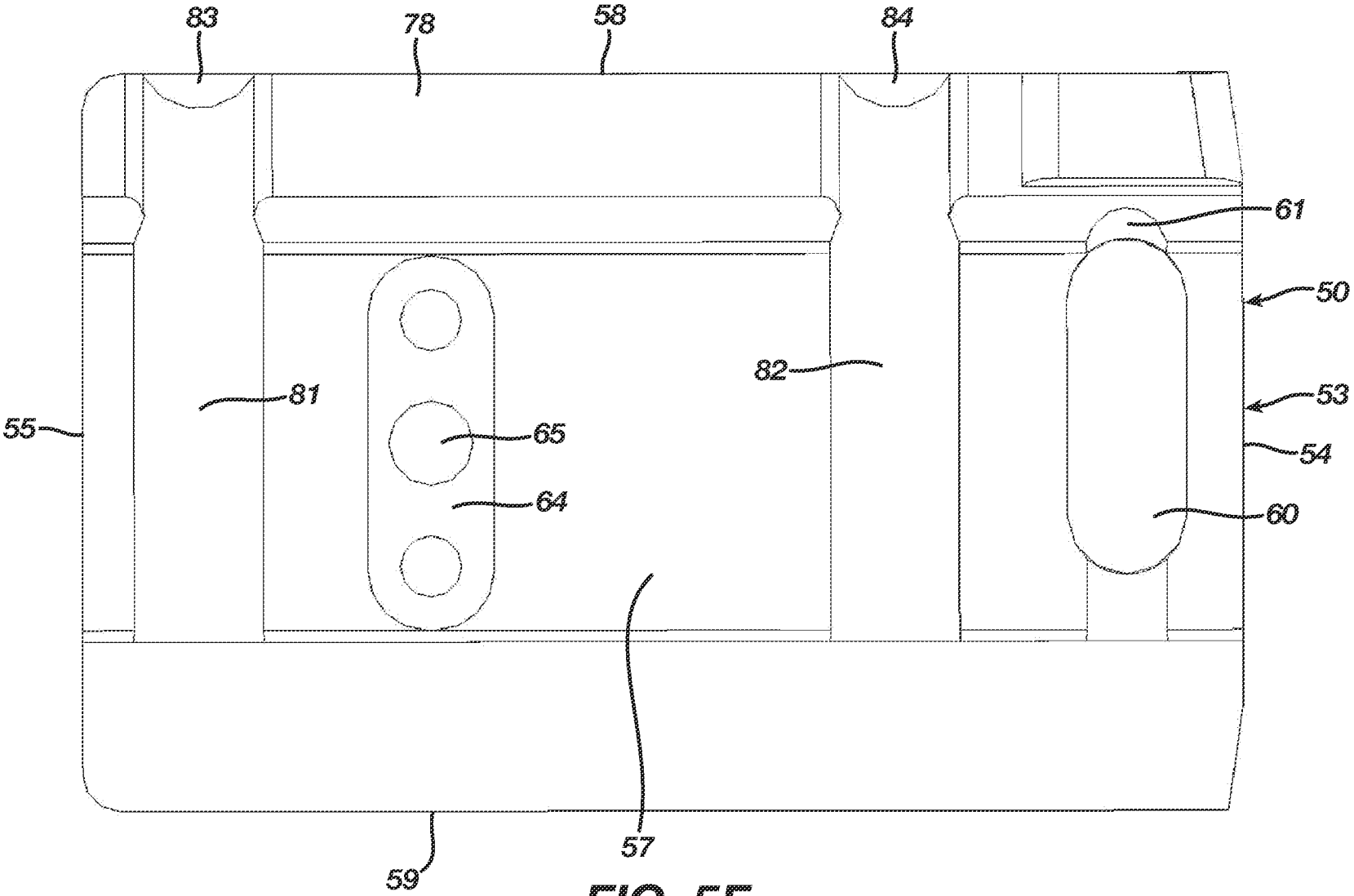
FIG. 5F is a bottom view illustrating the frame, the guide, and the first jaw of the base.

FIGS. 1A-1B illustrate a quick detach mounting system 10 that releasably attaches accessories such as, for example, optics, sights, laser pointers, flashlights, and the like, to equipment, such as, for example, rifles, pistols, shotguns, submachine guns, and the like. The quick detach mounting system 10 includes a base 11 securable with a rail for a piece of equipment and an adapter 12 releasably attachable with the base 11. The adapter 12 is configured to provide a point of attachment for accessories such that, after integration of the adapter 12 with the base 11, an accessory is attached to a piece of equipment. The quick detach mounting system 10 includes a lock 13 integrated with the base 11 that locks the adapter 12 with the base 11 while allowing a quick release of the adapter 12 from the base 11.

As illustrated in FIGS. 1A-1B and 2A-3C, the lock 13 includes a plunger 14, a latch 15, and an elastic device 16 such as a spring. The plunger 14 includes a head 17 that provides an actuation button for the lock 13, a first shaft 18 extending from the head 17, and a second shaft 19 having a lesser diameter extending from the first shaft 18 such that the first shaft 18 includes a stop 20. The first shaft 18 includes an aperture 21 that provides a securing point for the plunger 14 with the latch 15. The latch 15 includes a body 22 supporting a bolt 23 at a top 24 thereof. The bolt 23 in the preferred embodiment is oblong with a length greater than a width. The body 22 includes an opening 25 extending therethrough from a front 26 to a rear 27 configured to receive therein the plunger 14 at the first and second shafts 18 and 19. The body 22 includes an opening 28 therethrough configured to facilitate a securing of the body with the plunger 14 at the first shaft 18. The lock 13, as will be described more fully herein, integrates with the base 11 through an engagement of the plunger 14 and the latch 15 with the base 11, including a coupling of the plunger 14 with the latch 15, and an engagement of the elastic member 16 with the base 11 and the plunger 14.

As illustrated in FIGS. 1A-1B and 4A-4D, the adapter 12 includes a central beam 30, a platform 31, and an interface 32. The central beam 30 supports the platform 31 while the interface 32 extends below the central beam 30. The central beam 30 separates the interface 32 from the platform 31 such that, upon integration of the adapter 12 with the base 11 using the interface 32, the platform 31 remains located above the base 11. The platform 31 preferably is three-dimensional in form including a planar upper surface 33 that provides a stable securing point for accessories with the quick detach mounting system 10. The platform 31 at the upper surface 33 includes at least a first hole 34 and, in the preferred embodiment, first, second, and third holes 34-36 that facilitate attachment of accessories atop the platform 31. While the first, second, and third holes 34-36 may operate based upon a friction fit, the first, second, and third holes 34-36 in the preferred embodiment are threaded to receive therein a fixation device such as a screw that secures an accessory directly to the platform 31 or a mounting device such as a rail with the platform 31.

The interface 32 in the preferred embodiment tapers from a rear end 37 to a front end 38 such that the interface 32 is a wedge 39 that integrates with the base 11 in order for the adapter 12 to couple with the base 11. The interface 32 at a first side 40 includes a first tongue 41 that provides a securing surface for the interface 32 with the base 11. Likewise, the interface 32 at a second side 42 includes a second tongue 43 that provides a securing surface for the interface 32 with the base 11. The interface 32 at the front end 38 defines an opening 44 that provides an entrance or exit for the latch 15 of the lock 13 and in particular the bolt 23 of the latch 15 into or from the interface 32. The interface 32 beginning at the opening 44 defines a lock channel 45 that terminates adjacent the rear end 37. The interface 32 defines a lock pocket 46 operatively linked with the lock channel 45 at the termination thereof. The lock channel 45 and the lock pocket 46 are configured with respect to a height thereof to receive the bolt 23 of the latch 15 substantially, completely therein such that the bolt 23 traverses the lock channel 45 and remains securely locked within the lock pocket 46. The lock channel 45 at the opening 44 is wider than the bolt 23 of the latch 15 in order to allow the bolt 23 unobstructed entrance into or exit from the lock channel 45. The lock channel 45 in the preferred embodiment tapers from the opening 44 to the lock pocket 46 until a width of the lock channel 45 substantially, completely equals the width of the bolt 23 whereby the lock channel 45 facilitates movement of the latch 15 into a position for a delivery of the bolt 23 into the lock pocket 46. The lock pocket 46 in the preferred embodiment resides at an angle relative the lock channel 45 in order for the lock pocket 46 to hold the bolt 23 therein upon the delivery of the bolt 23 into the lock pocket 46. The lock pocket 46 in the preferred embodiment includes a width substantially, completely equal to the length of the bolt 23 whereby the lock pocket 46 frictionally engages the bolt 23 upon delivery therein such that the adapter 12 remains securely locked with the base 11.

As illustrated in FIGS. 1A-1B and 5A-7B, the base 11 includes a frame 50, a guide 51, and a clamp 52. The frame 50 includes a central beam 53 with a rear end 54, a front end 55, an upper surface 56, and a lower surface 57; a first side 58 extending above and below the central beam 53; and a second side 59 extending above and below the central beam 53. The frame 50 supports the guide 51 above the clamp 52 at the central beam 53 whereby the central beam 53 separates the clamp 52 from the guide 51 such that, upon securing of the base 11 with a rail for a piece of equipment using the clamp 32, the guide 51 remains located above the rail.

The frame 50 in the central beam 53 adjacent the rear end 54 includes a lock slot 60 therethrough configured to receive the bolt 23 of the latch 15 such that the bolt 23 extends from the lock slot 60 above the upper surface 56 in order for the bolt 23 to enter the lock channel 45 and the lock pocket 46 of the interface 32. The lock slot 60 further allows the bolt 23 to traverse the central beam 53 of the frame 50 upon movement of the latch 15 whereby the bolt 23 enters and exits the lock pocket 46 from the lock channel 45. The first side 58 adjacent the rear end 54 below the lower surface 57 includes a lock passage 61 therethrough that is in-line with the lock slot 60 and configured to receive therethrough the first shaft 18 and the second shaft 19 of the plunger 14. The first side 58 at the lock passage 61 includes a countersink 62 configured to receive the head 17 of the plunger 14 in order to assist in maintaining the plunger 14 coupled with the frame 50. The lock passage 61 locates the first and second shafts 18 and 19 beneath the central beam 53 whereby the second shaft 19 resides adjacent the second side 59 and the first shaft 18 aligns with the lock slot 60 such that the aperture 21 is accessible through the lock slot 60. The second side 59 adjacent the rear end 54 below the lower surface 57 includes a lock cavity 63 that is in-line with the lock slot 60 and configured to receive therein the elastic device 16.

The frame 50 in the lower surface 57 of the central beam 53 adjacent the front end 55 includes a lug groove 64. The frame 50 in the central beam 53 adjacent the front end 55 includes a hole 65 therethrough that opens into the lug groove 64. The lug groove 64 is designed to receive a lug 66 such that a fixation device such as a screw inserted through the hole 65 secures the lug 66 with the frame 50. The lug 66 fits within a slot of a rail for a piece of equipment and allows fore and aft adjustment on the rail as well as prevents fore and aft movement of the base 11 upon a securing of the base 11 with the rail.

The guide 51 in the preferred embodiment tapers from the rear end 54 to the front end 55 whereby the guide 51 is complementary with the interface 32 in order for the guide 51 to receive the interface 32 therein and integrate the interface 32 with the guide 51 such that the adapter 12 couples with the base 11. The guide 51 in accordance with the tapering thereof from the rear end 54 to the front end 38 defines a socket 67 that is funnel-shaped and complementary with the wedge 39 whereby the wedge 39 inserts into the socket 68 and integrates with the guide 51 such that the adapter 12 couples with the base 11. The guide 51 includes a first guide rail 68 extending from the first side 58 along the length thereof such that the first guide rail 68 resides above the central beam 53. The first guide rail 68 defines a first guide groove 69 complementary with the first tongue 41 of the interface 32 in order for the first guide groove 69 to receive therein the first tongue 41 during integration of the interface 32 with the guide 51. Likewise, the guide 51 includes a second guide rail 70 extending from the second side 59 along the length thereof such that the second guide rail 70 resides above the central beam 53. The second guide rail 70 defines a second guide groove 71 complementary with the second tongue 43 of the interface 32 in order for the second guide groove 71 to receive therein the second tongue 43 during integration of the interface 32 with the guide 51. The first guide rail 68 and the second guide rail 70 each angle inward relative to the first and second sides 58 and 59 from the rear end 54 to the front end 55 to produce the tapering of the guide 51 resulting in the guide 51 being complementary with the interface 32. Moreover, the angling of the first guide rail 68 and the second guide rail 70 creates an entrance 72 into the socket 67 that facilitates easier insertion of the interface 32 into the guide 51. The guide 51 in the preferred embodiment is minimally smaller in length than the interface 32 in order for the guide 51 to securely receive the interface 32 therein upon integration of the interface 32 with the guide 51. Nevertheless, one of ordinary skill in the art will recognize the guide 51 may be the same length or minimally larger in length than the interface 32.

Figure 7A:
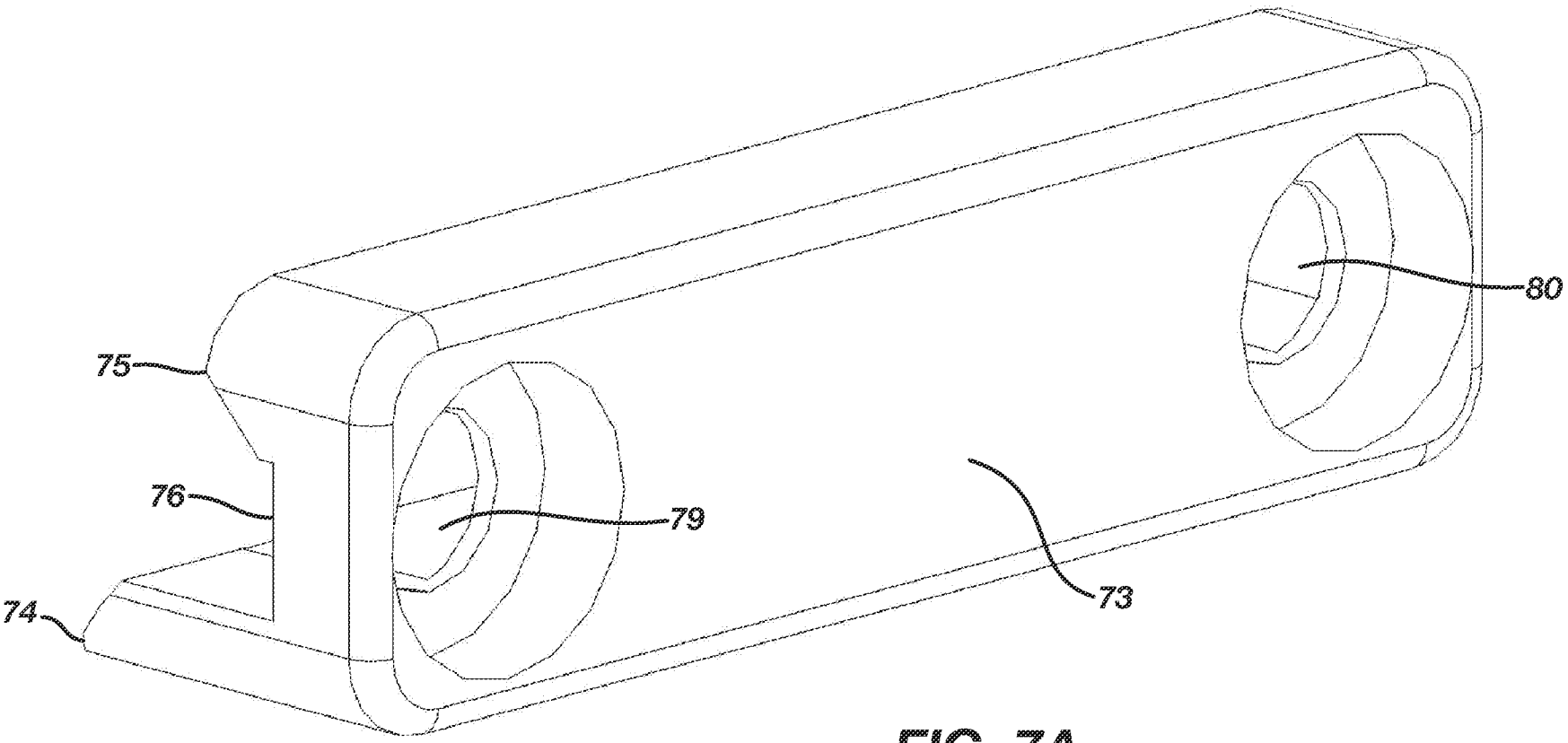
FIGS. 7A-7B are top isometric views illustrating a second jaw of the base for the quick detach mounting system according to the preferred embodiment.
Figure 7B:
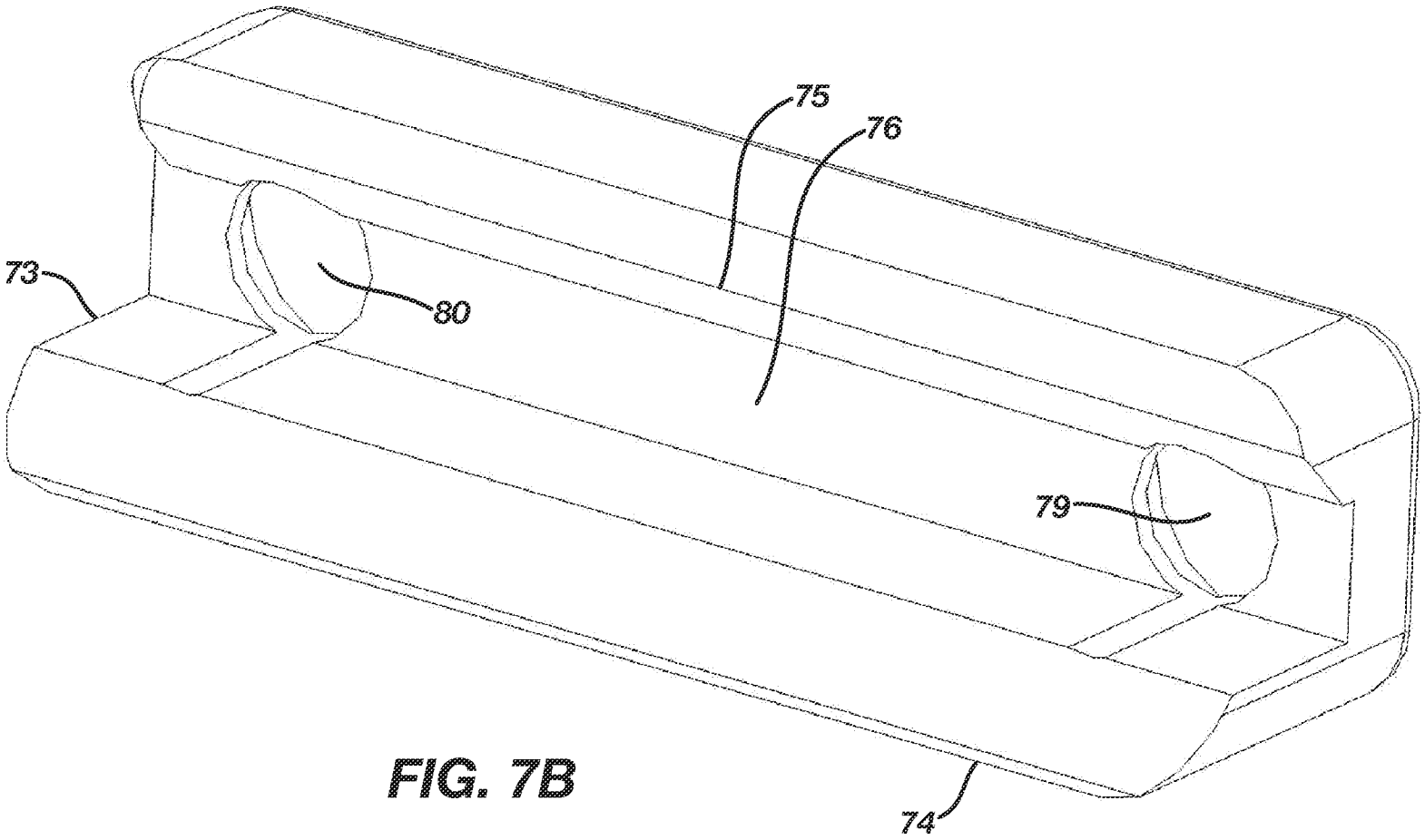

The clamp 52 in order to facilitate a securing of the base 11 with a rail for a piece of equipment includes a moveable first jaw body 73 with a first jaw 74 extending therefrom, as illustrated in FIGS. 7A-7B, that integrates with the frame 50 at the first side 58 thereof and a fixed second jaw 75 extending from the frame 50 at the second side 59 thereof. The first jaw body 73 integrates with the frame 50 at the first side 58 through the first jaw body 73 including a jaw body tongue 75 above a jaw body groove 76 and the first side 58 including a corresponding and complementary first side groove 77 above a corresponding and complementary first side tongue 78. In accordance therewith, the jaw body tongue 75 inserts into the first side groove 77 while first side tongue 78 inserts into the jaw body groove 76 whereby the first jaw body 73 integrates with the first side 58 such that the first jaw 74 extends under the frame 50 beyond the first side 58 but separated from the lower surface 57 of the central beam 53. The first jaw body 73 secures with the frame 50 at the first side 58 through the first jaw body 73 including first and second openings 79 and 80 and the frame 50 including corresponding first and second passageways 81 and 82 beginning at first and second openings 83 and 84 through the first side 58 and first and second holes 85 and 86 through the second side 59, which in the preferred embodiment includes threads. After placement of the first jaw body 73 in abutting relationship with the frame 50 at the first side 58, fixation devices such as screws inserted through the first and second openings 79 and 80, the first and second openings 83 and 84, and the first and second passageways 81 and 82 and into the first and second holes 85 and 86 for engagement therewith connect the first jaw body 73 with the frame 50 at the first side 58. The second jaw 75 is in opposed relationship with the first jaw 74 and extends under the frame 50 beyond the second side 58 but separated from the lower surface 57 of the central beam 53.

Figure 6A:
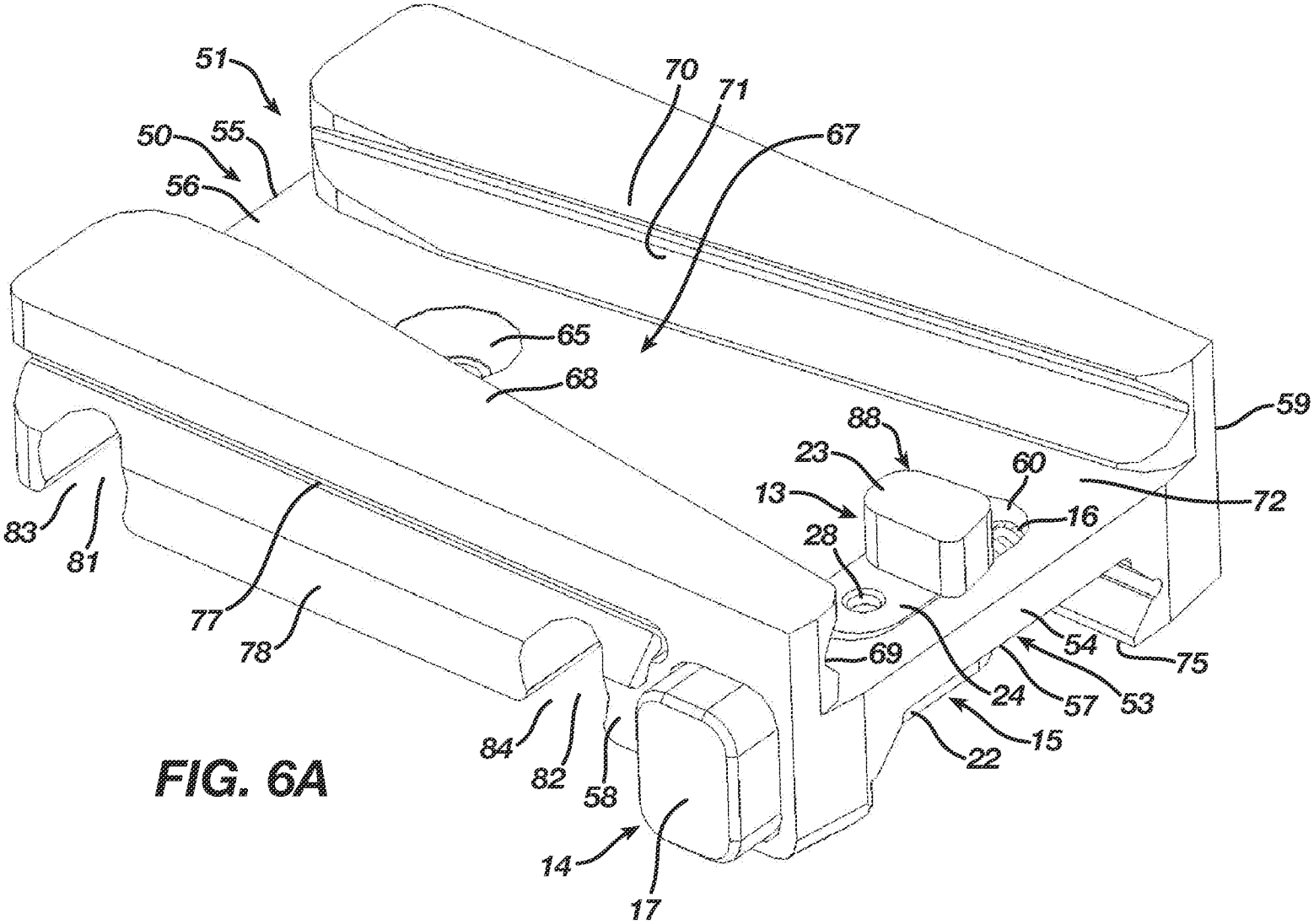
FIG. 6A is a top isometric view illustrating the lock integrated with the frame of the base.
Figure 6B:
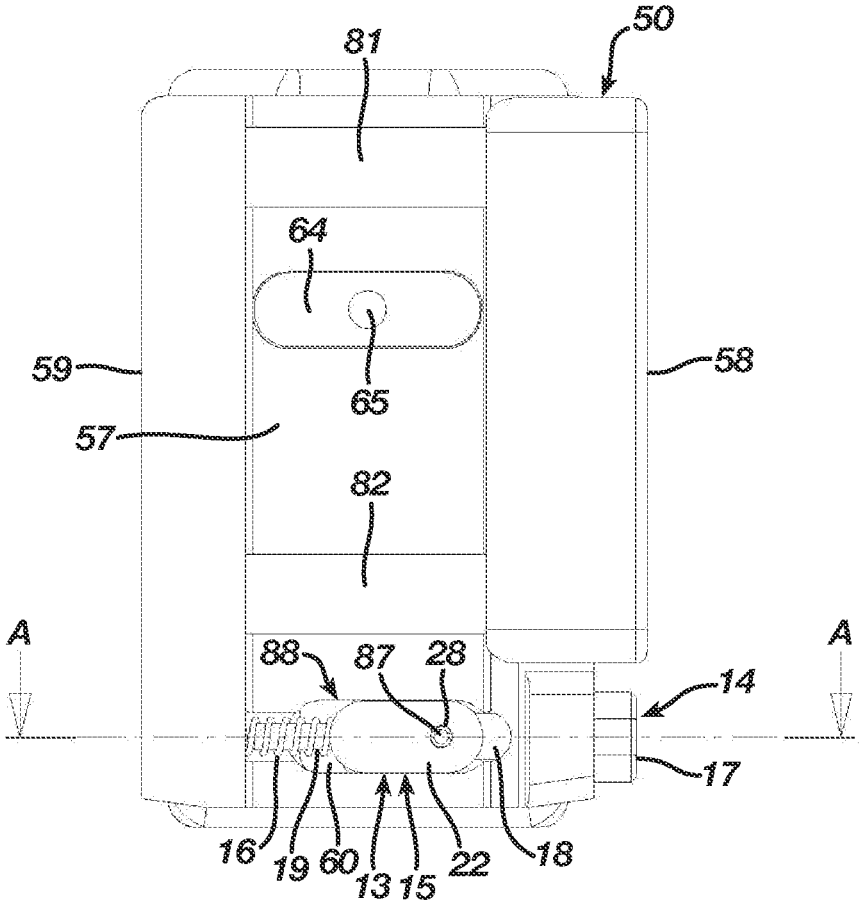
FIG. 6B is a bottom view illustrating the lock integrated with the frame of the base.
Figure 6C:
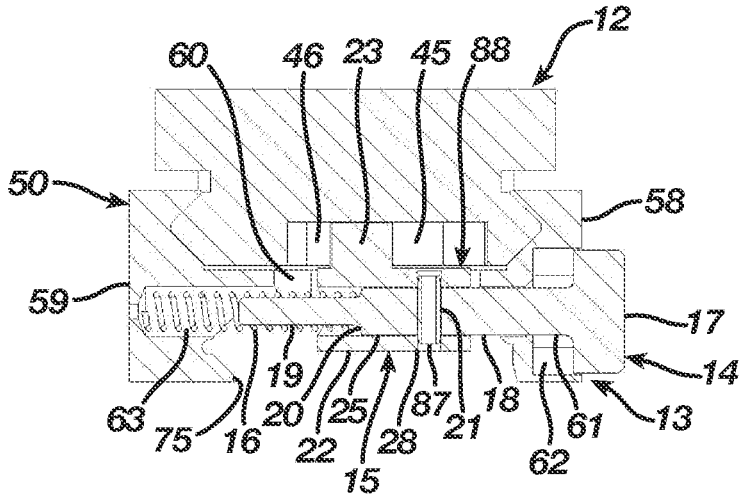
FIG. 6C is a cross-sectional view taken along lines A-A of FIG. 6B illustrating the lock integrated with the frame of the base.

The lock 13 as illustrated in FIGS. 6A-6C integrates with the base 11 as follows. The elastic device 16 inserts into the lock cavity 63 whereby the elastic device 16 protrudes from the lock cavity 63 into and underneath the lock slot 60. The latch 15 integrates with the base 11 via the body 22 inserting through the lock slot 60 until the bolt 23 resides at the upper surface 56 of the central beam 53 above the lock slot 60. The body 22 inserts through lock slot 60 in an orientation whereby the opening 28 at the front 26 of the body 22 aligns with the lock passage 61 and at the rear 27 of the body 22 aligns with the lock cavity 63. In accordance with the opening 28 aligning with the lock cavity 63, the opening 28 at the rear 27 of the body 22 receives therein the elastic device 16. After insertion of the body 22 through lock slot 60, the plunger 14 at the first and second shafts 18 and 19 inserts through the lock passage 61 and into the opening 28 at the front 26 of the body 22 until the aperture 21 of the first shaft 18 aligns with the opening 28 of the body 22, the second shaft 19 inserts into the elastic device 16, and the elastic device 16 abuts the stop 20 of the first shaft 18. Upon alignment of the aperture 21 with the opening 28 of the body 22, a pin 87 inserts into the opening 28 and through the aperture 21 such that the pin 87 couples the plunger 14 with the latch 15, thereby integrating the lock 13 with the base 11. The elastic device 16, which is located between the lock cavity 63 and the stop 20, biases the lock 13 to a lock position 88. In the preferred embodiment, the lock position 88 is the normal position of the lock 13, whereby the elastic device 16 pushes the plunger 14 and thus the latch 15 such that the latch 15 moves within the lock slot 60 towards the first side 58 of the frame 50 and the head 17 of the plunger 14 fits within the countersink 62 while being spaced apart from a bottom thereof.

As illustrated in FIGS. 8A-11B, the base 11 secures with a rail 89 for a piece of equipment and the adapter 12 integrates with the base 11 including a locking of the adapter 12 with the base 11 as follows. The base 11 secures with a rail 89 using the clamp 52 thereof at a location desired for the attachment of an accessory for the piece of equipment. More particularly, with the first jaw body 73 loosened relative to the first side 58 of the frame 50, the second jaw 75 fits under the rail 89 while the lug 66 inserts within a slot of a rail. Moreover, the first jaw 74 fits under the rail 89 opposite from the second jaw 75 followed by a tightening of the first jaw body 73 against the first side 58 of the frame 50 using the fixation devices, thereby securing the base 11 with the rail 89.

Figure 8A:
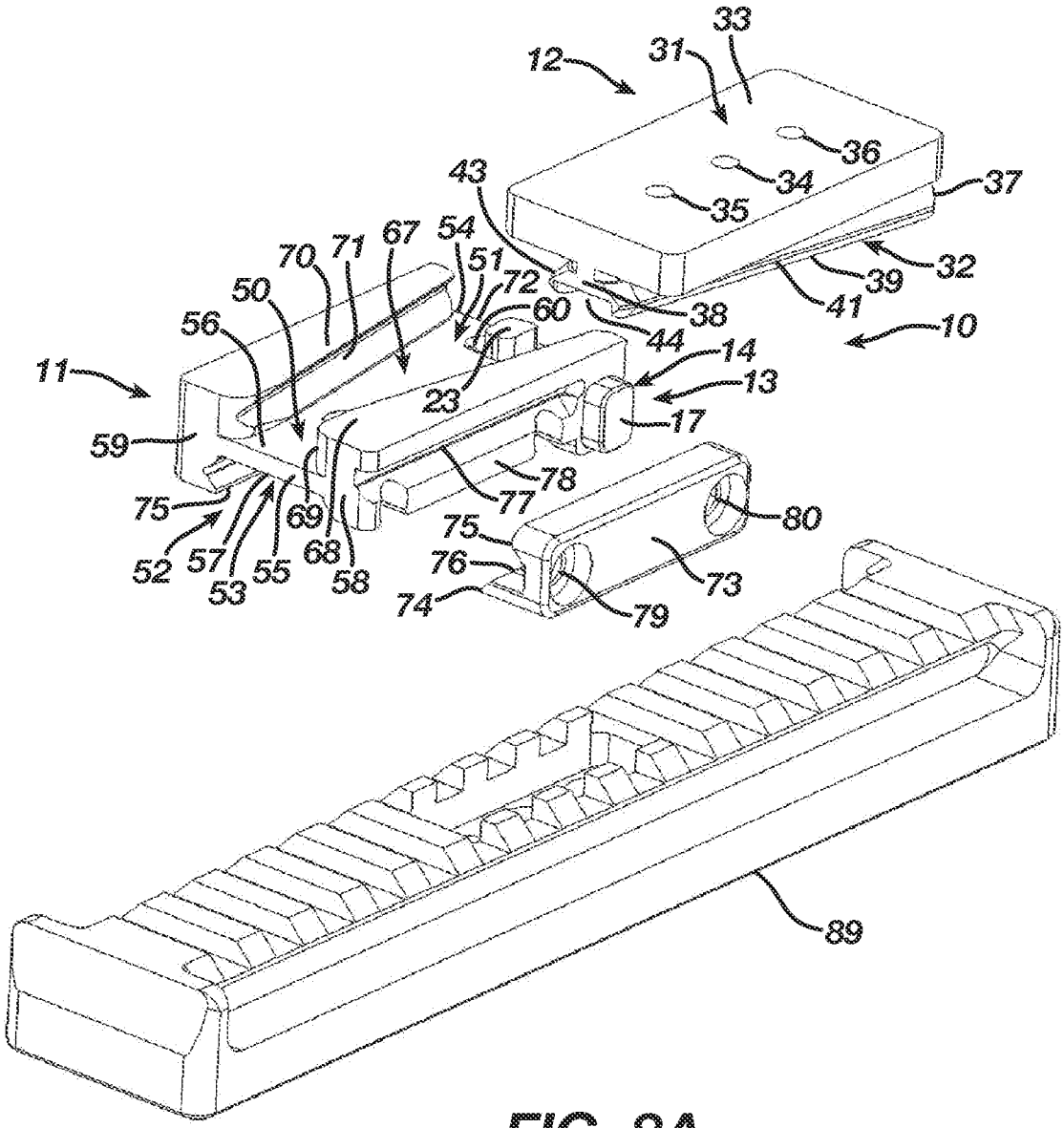
FIGS. 8A-8C are top isometric views illustrating the quick detach mounting system according to the preferred embodiment being mounted atop a rail.
Figure 8B:
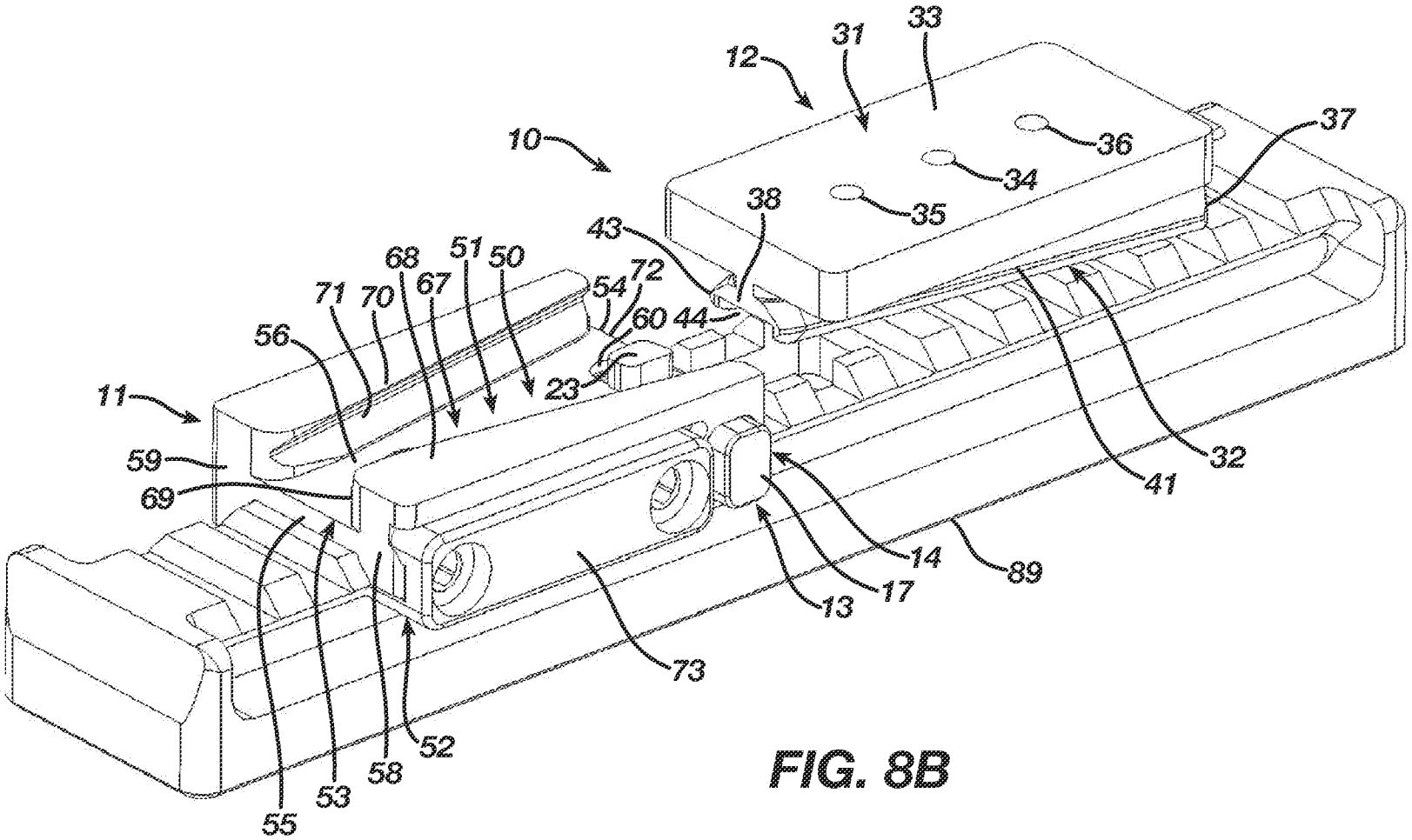
Figure 8C:
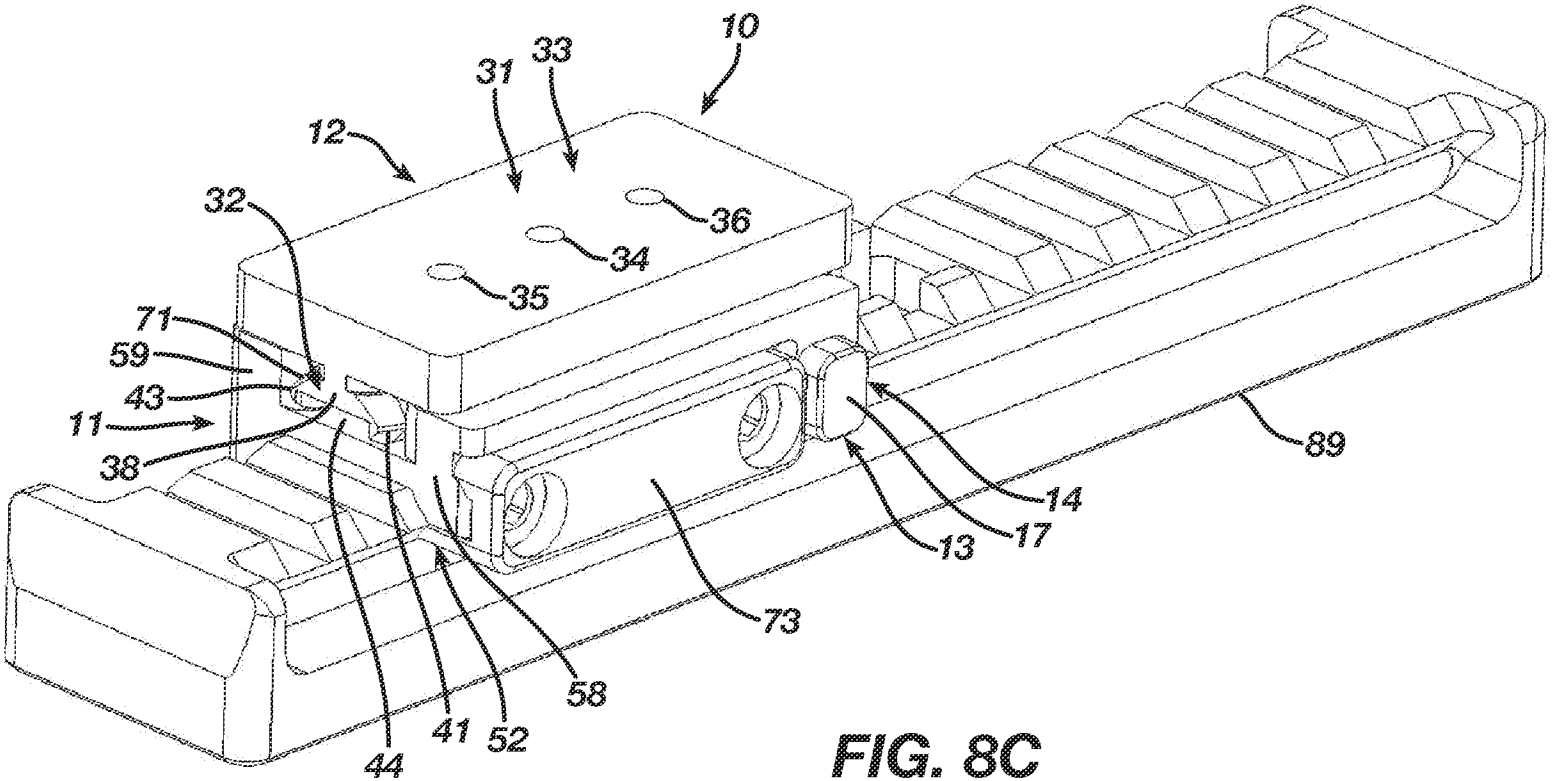
Figure 9A:
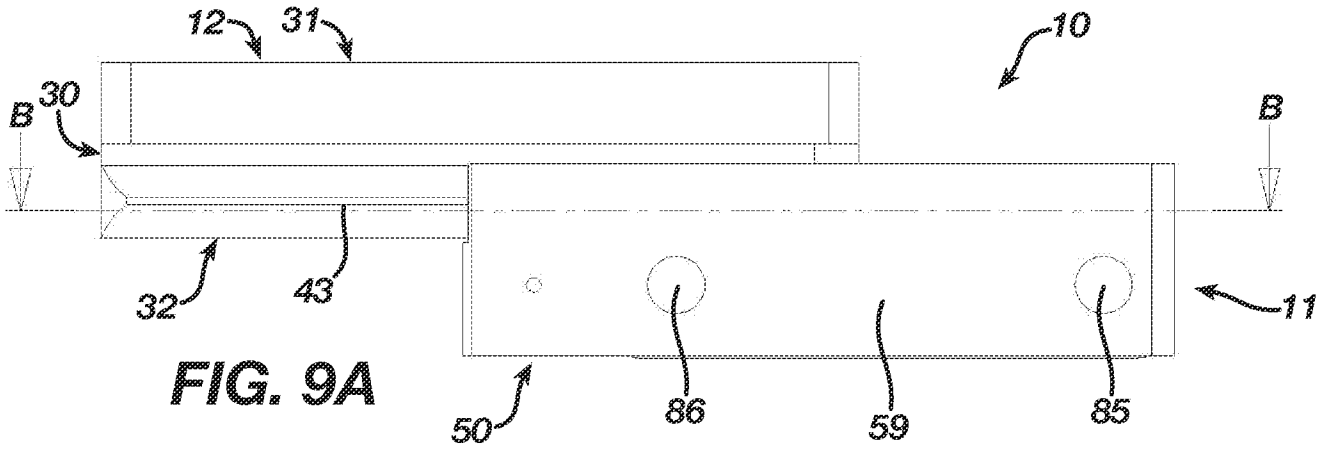
FIG. 9A is a side view illustrating the adapter being integrated with or removed from the base.
Figure 9B:
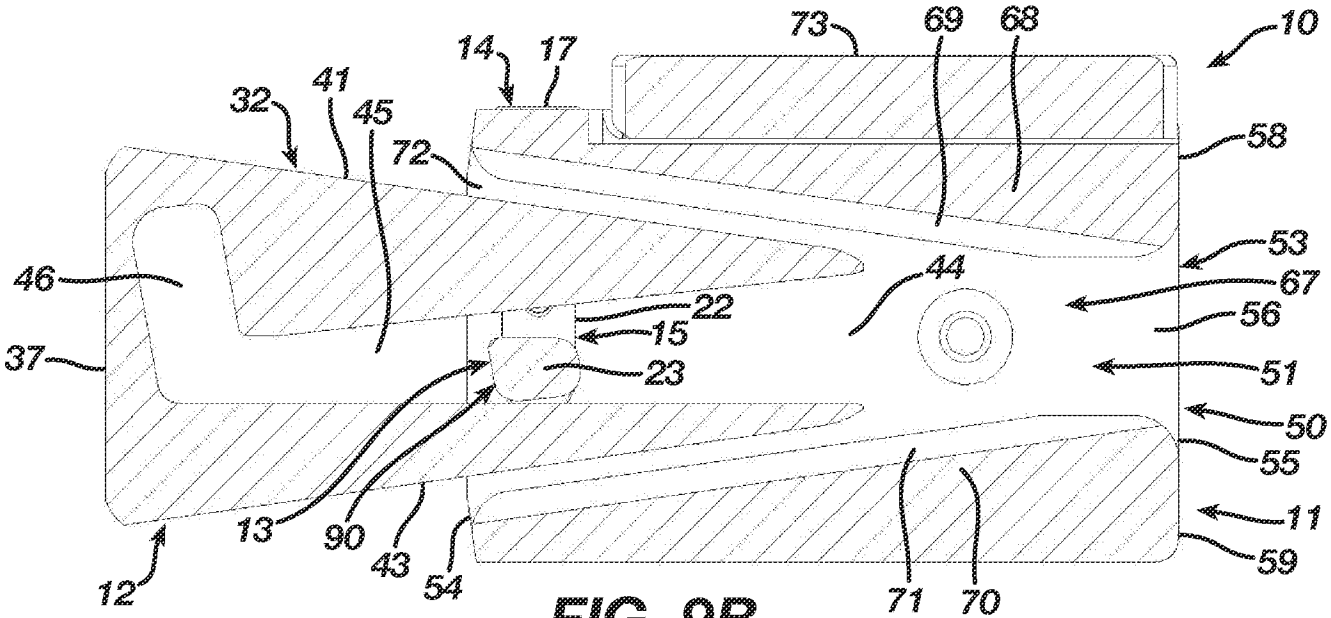
FIG. 9B is a cross-sectional view taken along lines B-B of FIG. 9A illustrating the adapter being integrated with or removed from the base.
Figure 10A:
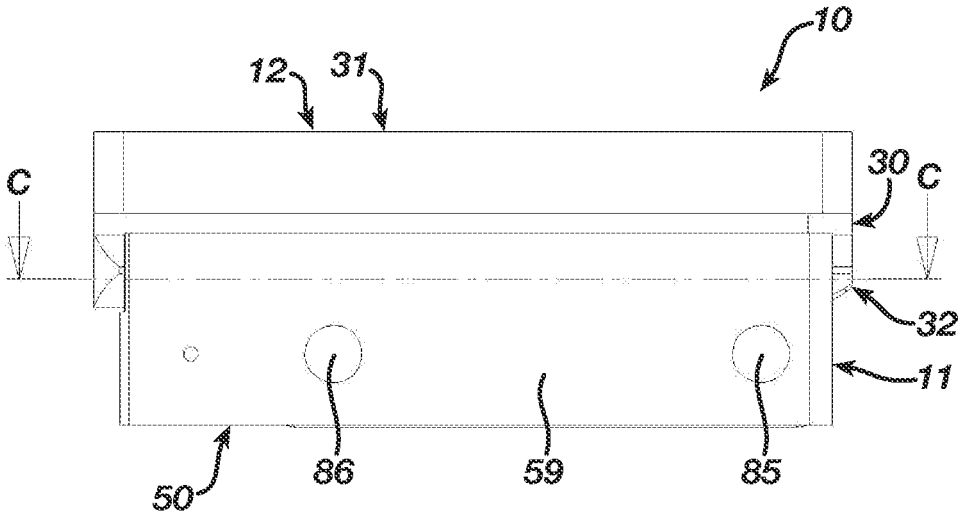
FIG. 10A is a side view illustrating the adapter integrated with the base.
Figure 10B:
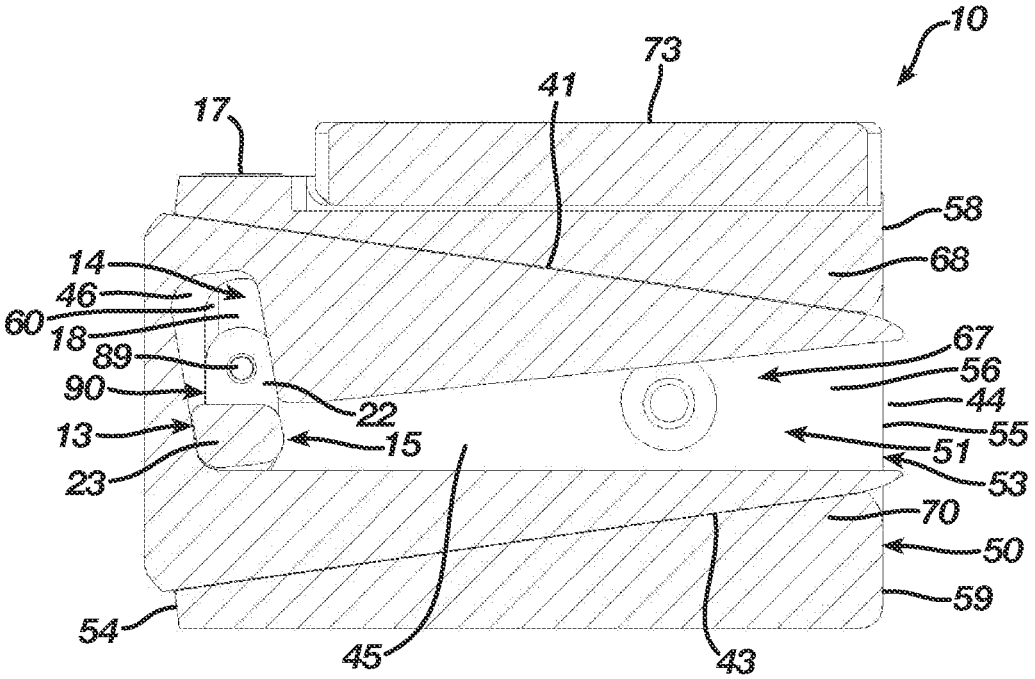
FIG. 10B is a cross-sectional view taken along lines C-C of FIG. 10A illustrating the adapter integrated with the base and the lock disengaged.
Figure 11A:
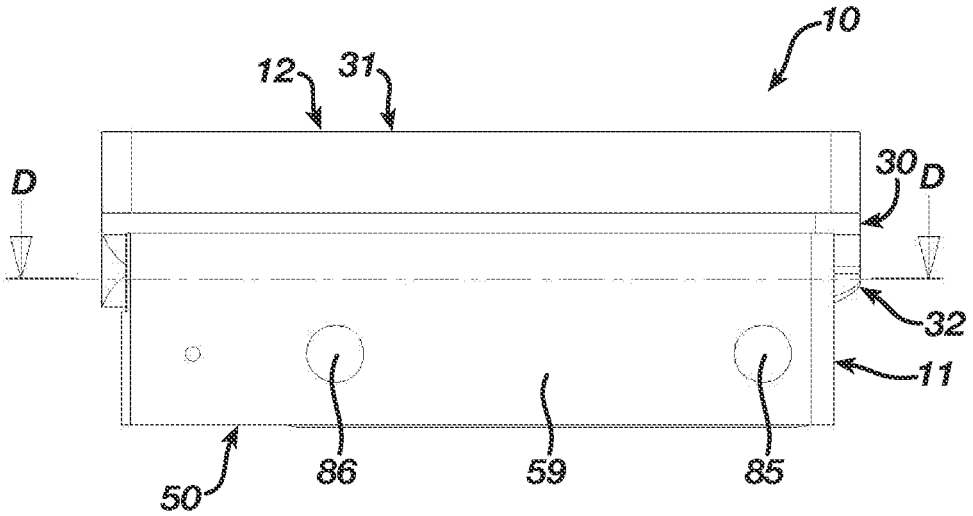
FIG. 11A is a side view illustrating the adapter integrated with the base.
Figure 11B:
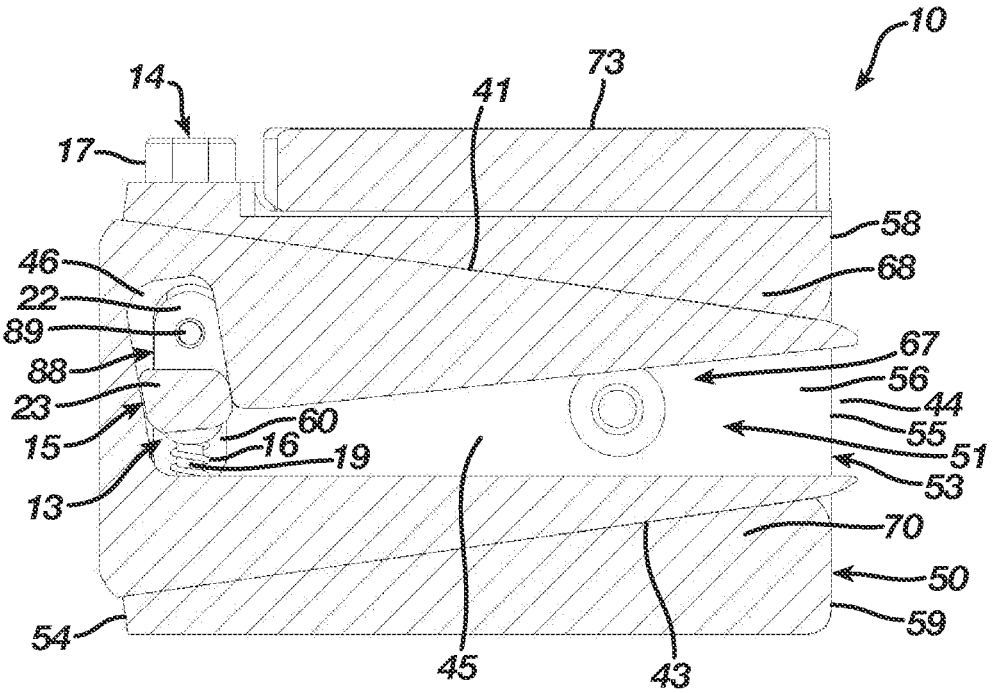
FIG. 11B is a cross-sectional view taken along lines D-D of FIG. 11A illustrating the adapter integrated with the base and the lock engaged.

After securing the base 11 with the rail 89, integration of the adapter 12 with the base 11 begins with the adapter 12 at the front end 37 of the interface 32 aligning with the guide 51 at the rear end 54 of the central beam 53 as illustrated in FIG. 8B. More particularly, the lock channel 45 of the interface 32 at the opening 44 aligns with the bolt 23 of the latch 15. Upon aligning the opening 44 with the bolt 23, the interface 32 at the front end 37 thereof inserts into the guide 51 at the entrance 72 of the socket 67 while the bolt 25 enters the lock channel 45 at the opening 44. The interface 32 at the front end 37 easily and without obstruction enters the guide 51 between the first and second guide rails 68 and 70 at the rear end 54 of the central beam 53 because the entrance 72 is wider than the front end 37 of the interface 32 due to the angling of the first and second guide rails 68 and 70. Similarly, the bolt 23, based upon the width of the opening 44, enters the lock channel 45 without obstruction regardless of whether the lock 13 resides in the lock position 88 or the lock 13 has been manipulated to reside in an unlock position 90 as illustrated in FIGS. 9B and 10B. Manipulation of the lock 13 to the unlock position 90 includes pushing the head 17 of the plunger 14 to the bottom of the countersink 62 resulting in the plunger 14 compressing the elastic device 16 and moving the latch 15 and thus the bolt 23 towards the second side 59 of the frame 50. The interface 32, regardless of whether the lock 13 resides in the lock position 88 or the unlock position 90, inserts into the socket 67 between the first and second guide rails 68 and 70 as illustrated in FIGS. 9A-9B. The interface 32 further inserts completely into the socket 67 as illustrated in FIGS. 10A-10B until the first tongue 41 and the second tongue 43 of the interface 32 integrate respectively with the first guide groove 69 of the first guide rail 68 and the second guide groove 71 of the second guide rail 70, thereby coupling the interface 32 with the guide 51. When the lock 13 resides in the unlock position 90, the interface 32, during the insertion thereof into the guide 51, receives the bolt 23 therein via the lock channel 45 as illustrated in FIG. 9B. Upon full insertion of the interface 32 into the socket 67 of the guide 51, the interface 32 receives the bolt 23 therein via the lock channel 45 until the bolt 23 resides at the intersection of the lock channel 45 and the lock pocket 46 as illustrated in 10B. Release of the head 17 of the plunger 14 results in the elastic device 16 returning the lock 13 from the unlock position 90 to the lock position 88 such that the bolt 23 enters the lock pocket 46 as illustrated in FIG. 11B, thereby locking the interface 32 within the guide 51 and thus the adapter 12 with the base 11 as illustrated in FIG. 8C. In the alternative, when the lock 13 resides in the lock position 88, the interface 32, during the insertion thereof into the guide 51, initially receives the bolt 23 into the lock channel 45 due to the width of the opening 44. As the interface 32 continues insertion into the guide 51, the bolt 23, based upon the tapering of the lock channel 45 to a width substantially, completely equal to the width of the bolt 23, contacts the interface 32 at the lock channel 45 such that the interface 32 moves the lock 13 from the lock position 88 towards the unlock position 90. Upon full insertion of the interface 32 into the socket 67 of the guide 51, the tapering of the lock channel 45 and the consequent contact of the bolt 23 with the interface 32 at the lock channel 45 results in the interface 32 moving the lock 13 completely to the unlock position 90 as illustrated in FIG. 10B. Moreover, on account of the interface 32 receiving the bolt 23 therein via the lock channel 45 until the bolt 23 resides at the intersection of the lock channel 45 and the lock pocket 46 as illustrated in 10B, the elastic device 16 returns the lock 13 from the unlock position 90 to the lock position 88 such that the bolt 23 enters the lock pocket 46 as illustrated in FIG. 11B, thereby locking the interface 32 within the guide 51 and thus the adapter 12 with the base 11 as illustrated in FIG. 8C.

Removal of the interface 32 from the guide 51 and thus the adapter 12 from the base 11 includes moving the lock 13 from the lock position 88 to the unlock position 90 whereby the bolt 23 progresses from the lock pocket 46 as illustrated in FIG. 11B to the intersection of the lock pocket 46 and the lock channel 45 as illustrated in 10B. After disengaging the lock 13, the interface 32 is withdrawn from engagement with the first and second guide rails 68 and 70 as illustrated in FIGS. 9A-9B. The interface 32 further is withdrawn completely from the socket 67 of the guide 51 followed by a release of the lock 13 and the subsequent return of the lock 13 from the unlock position 90 to the lock position 88. In accordance therewith, the adapter 12 is now completely removed from the base 11 as illustrated in FIG. 8B.

Figure 12A:
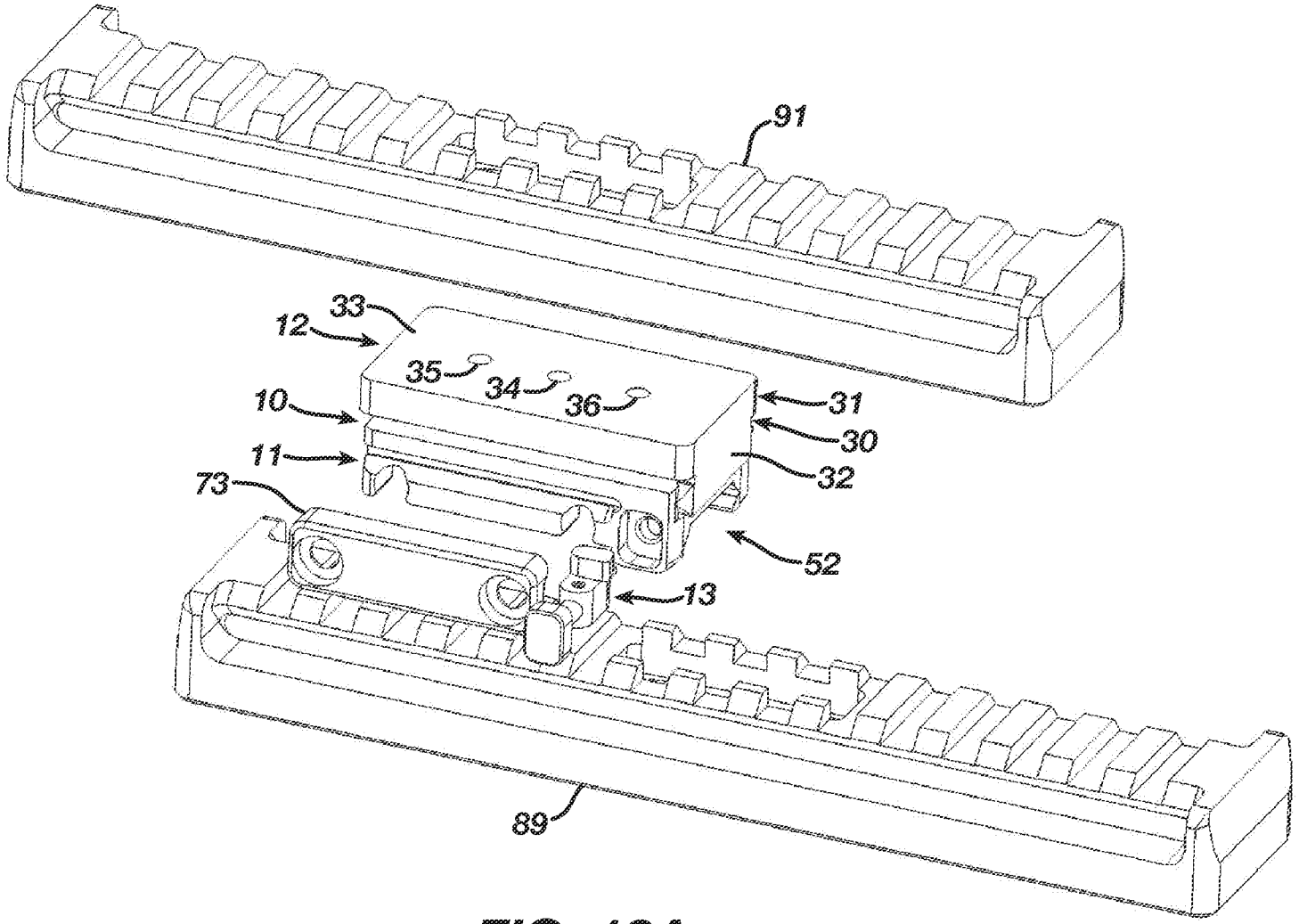
FIGS. 12A-12B are top isometric views illustrating examples for a mounting of accessories atop a rail using the quick detach mounting system according to the preferred embodiment.

The securing of the base 11 with the rail 89 for a piece of equipment as illustrated in FIG. 8B followed by the integration of the adapter 12 with the base 11 and a locking of the adapter 12 with the base 11 using the lock 13 as illustrated in FIG. 8C couples the quick detach mounting system 10 with the piece of equipment thereby facilitating releasable attachment of accessories with the piece of equipment. The platform 31 of the adapter 12, which resides above the base 11, provides a securing point for an accessory with the quick detach mounting system 10 and thus the piece of equipment. An accessory such as an optic, a sight, a laser pointer, and the like may mount directly to the platform 31 using at least one of the first, second, and third holes 34-36 and at least one corresponding screw. Alternatively, a mounting device, such as, for example, an accessory rail 91 as illustrated in FIG. 12A, may be mounted atop the platform 31 using at least one of the first, second, and third holes 34-36 and at least one corresponding screw. After connecting the accessory rail 91 with the platform 31, an accessory such as an optic, a sight, a laser pointer, a flashlight, and the like mounts on the accessory rail 91. The adapter 12 in accordance with its ability to integrate with and release from the base 11 provides the quick detach mounting system 10 with the capability of quickly attaching and detaching the accessory with the piece of equipment.

Figure 12B:
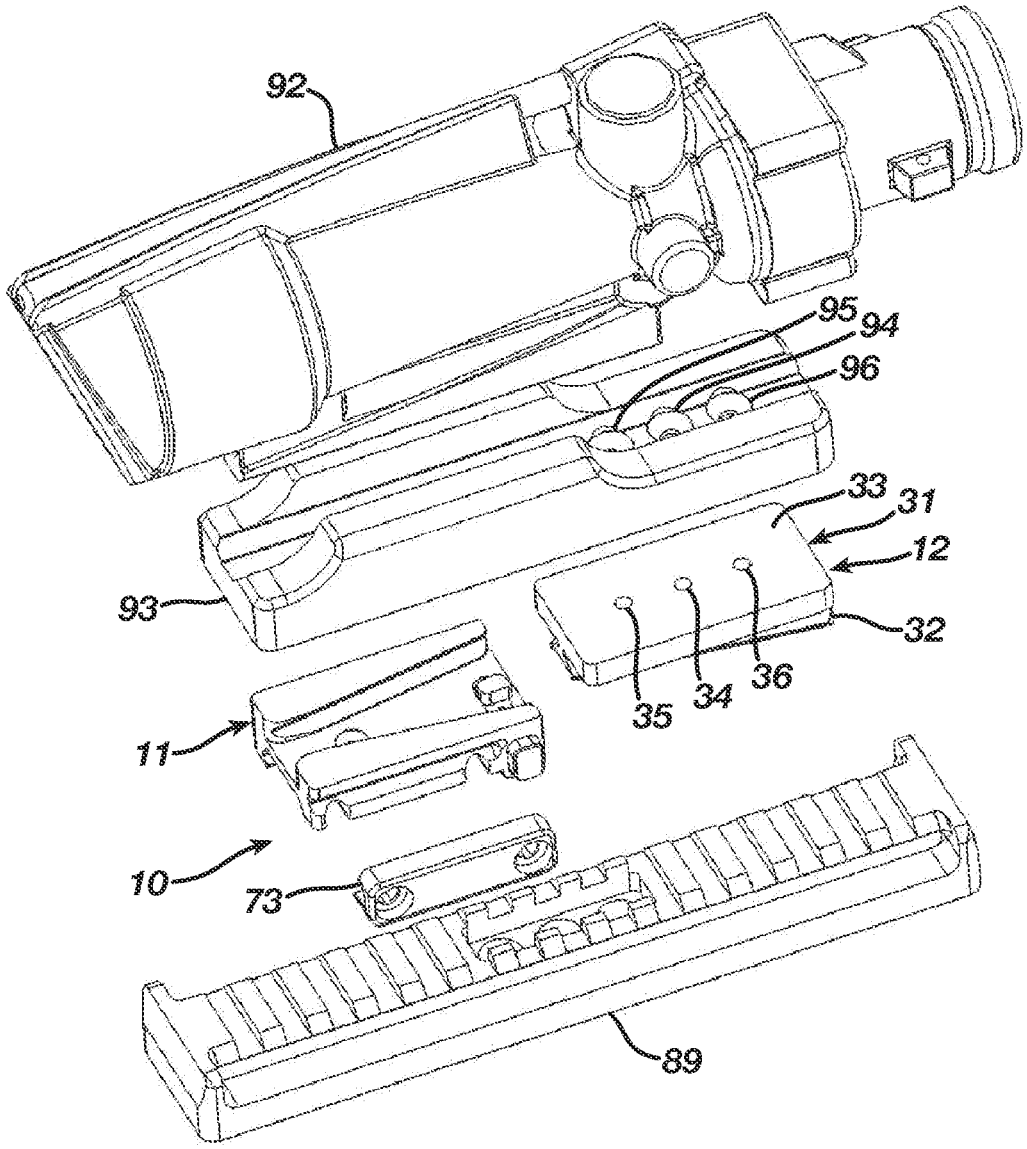

In an example of the quick detach mounting system 10 illustrated in FIG. 12B, the base 11 secures with the rail 89, which, in the example, is a rail for weapon such as a rifle, pistol, or shotgun. An accessory, which, in the example, is an optic 92 and more particularly a Trijicon® ACOG®, secures with a mount 93 configured to receive the optic 92. The mount 93 in order to secure atop the platform 31 includes first, second, and third holes 94-96 corresponding with the first, second, and third holes 34-36 of the platform 31. The mount 93 accordingly attaches to the platform 31 via screws inserted through the first, second, and third holes 94-96 and into the first, second, and third holes 34-36 of the platform 31 whereby the optic 92 is mounted atop the platform 31. The adapter 12 in accordance with its ability to integrate with and release from the base 11 provides the quick detach mounting system 10 with the capability of quickly attaching and detaching the optic 92 with the weapon. Although the quick detach mounting system 10 allows fast deployment when attaching the optic 92 with the weapon, the adapter 12, when locked with the base 11 via the lock 13, rigidly integrates with the base 11 such that the optic 92 maintains its "zero" relative to the weapon over multiple attachments and detachments.

While the quick detach mounting system 10 includes at least one adapter 12 and at least one base 11, the quick detach mounting system 10 may include multiple adapters 12 used with one base 11 or multiple bases 11. Multiple adapters 12 used with one base 11 permit switching among multiple accessories employed based upon the needs of a user. Illustratively, a user may switch between a day optic and a night optic for a weapon without concern over whether the optic has maintained its "zero" relative to the weapon. Moreover, the quick detach mounting system 10 allows for fast deployment among multiple optics without concern over returning the optic to the weapon in a position that maintains its "zero" relative to the weapon because the base 11 remains secured with the weapon regardless of the adapter 12 and the optic mounted thereon. Multiple adapters 12 used with multiple bases 11 permit an alignment among accessories or use of a larger accessory. Illustratively, a quick detach mounting system 10 at the front of a weapon with a front sight thereon and a quick detach mounting system 10 at the rear of the weapon with a rear sight thereon will align the front and rear sights. In addition, two quick detach mounting systems 10 with scope rings attached thereto appropriately spaced along a weapon would allow mounting of a larger optic atop the weapon.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

The invention claimed is:

1. A quick detach mounting system, comprising:

a base, comprising:

a frame including a rear end, a front end, and a lock slot adjacent the rear end, a guide atop the frame tapering from the rear end to the front end to define a socket, the guide comprising a first guide rail defining a first guide groove and a second guide rail defining a second guide groove, and a clamp configured to secure the base with a rail;

a lock configured to integrate with the base such that a bolt thereof resides above the lock slot, the lock being moveable along the lock slot of the base between a lock position and an unlock position; and an adapter, comprising:

a central beam, a platform atop the central beam, the platform configured to provide a securing point for accessories with the adapter, and an interface extending below the central beam, wherein:

the interface tapers from a rear end to a front end, the interface at a first side includes a first tongue whereby the first tongue and the first guide groove are complementary, the interface at a second side includes a second tongue whereby the second tongue and the second guide groove are complementary, the interface defines a lock channel beginning with an opening at the front end and terminating adjacent the rear end, the lock channel being configured to receive the bolt of the lock therein, and the interface defines a lock pocket operatively linked with the lock channel, the lock pocket configured to receive the bolt therein as the bolt exits the lock channel and enters the lock pocket when the lock moves from the unlock position to the lock position.

2. The quick detach mounting system of claim 1, the adapter being configured for integration with the base, wherein:

the interface inserts into the pocket of the guide until the first tongue of the interface integrates with the first guide groove of the first guide rail and the second tongue of the interface integrates with the second guide groove of the second guide rail;

the bolt of the lock enters the lock channel at the opening of the interface;

the bolt, as the interface inserts into the pocket of the guide, traverses the lock channel whereby the lock resides in the unlock position; and the bolt, upon insertion of the interface into the pocket of the guide, enters the lock pocket from the lock channel as the lock moves from the unlock position to the lock position, thereby locking the interface within the guide such that the adapter integrates with the base.

3. The quick detach mounting system of claim 1, the adapter being configured for removal from the base, wherein:

the bolt, upon movement of the lock from the lock position to the unlock position, enters the lock channel from the lock pocket, thereby unlocking the adapter from the base;

the interface withdraws from the pocket of the guide until the first tongue of the interface exits the first guide groove of the first guide rail and the second tongue of the interface exits the second guide groove of the second guide rail;

the bolt, as the interface withdraws from the pocket of the guide, traverses the lock channel and exits the lock channel at the opening of the interface, whereby the lock moves from the unlock position to the lock position; and the interface exits the pocket of the guide and the lock, thereby releasing the interface from within the guide in order to remove the adapter from the base.

* * * * *